US011062583B1

(12) United States Patent
Sathaye et al.

(10) Patent No.: US 11,062,583 B1
(45) Date of Patent: Jul. 13, 2021

(54) PARENT AND CHILD PAIRED SAFETY DEVICES AND METHOD OF USE THEREOF

(71) Applicant: PROXMAL SYSTEMS INC., Saratoga, CA (US)

(72) Inventors: Archana Sathaye, Saratoga, CA (US); Ronalee Mann, Belmont, CA (US)

(73) Assignee: PROXMAL SYSTEMS INC., Saratoga, CA (US)

( * ) Notice: Subject to any disclaimer, the term of this patent is extended or adjusted under 35 U.S.C. 154(b) by 0 days.

(21) Appl. No.: 17/094,257

(22) Filed: Nov. 10, 2020

(51) Int. Cl.
*G08B 21/02* (2006.01)

(52) U.S. Cl.
CPC ..... *G08B 21/0233* (2013.01); *G08B 21/025* (2013.01); *G08B 21/0225* (2013.01); *G08B 21/0247* (2013.01); *G08B 21/0266* (2013.01); *G08B 21/0277* (2013.01)

(58) Field of Classification Search
CPC ..... G08B 21/0233; G08B 21/02225; G08B 21/0247; G08B 21/025; G08B 21/0266; G08B 21/0277
USPC ..... 340/691.3, 573.4, 573.3, 539.1–539.15, 340/539.21, 539.23
See application file for complete search history.

(56) References Cited

U.S. PATENT DOCUMENTS 5,552,773 A * 9/1996 Kuhnert ..... C08G 63/676 340/573.1
5,652,569 A * 7/1997 Gerstenberger ... G08B 21/0216 340/328
5,661,460 A * 8/1997 Sallen ..... G01S 13/84 340/539.1
6,078,260 A 6/2000 Desch
6,084,517 A * 7/2000 Rabanne ..... G01S 19/17 340/573.4
6,265,974 B1 * 7/2001 D'Angelo ..... G08B 13/1409 340/328
6,472,986 B1 * 10/2002 Sorriaux ..... G08B 13/1427 340/568.1
6,847,295 B1 * 1/2005 Taliaferro ..... G08B 21/0211 340/539.1
6,989,748 B2 * 1/2006 Rabanne ..... G01S 19/17 340/539.32
7,046,153 B2 * 5/2006 Oja ..... G08B 21/0222 340/573.4
7,084,771 B2 8/2006 Gonzalez
7,259,671 B2 * 8/2007 Ganley ..... G08B 13/1427 340/539.11
7,259,682 B2 * 8/2007 Vannerus ..... G08B 21/0247 340/539.11
8,325,015 B2 12/2012 Hall
8,878,670 B2 * 11/2014 Rosen ..... G08B 21/0219 340/539.13
9,165,447 B2 * 10/2015 Jenkins ..... G08B 13/2462
9,615,199 B1 4/2017 Haney
10,026,287 B2 7/2018 Sarkar
10,720,037 B2 7/2020 Myers et al.
2010/0267361 A1 10/2010 Sullivan
2014/0210616 A1 * 7/2014 Ramachandran .. G08B 21/0227 340/539.13

(Continued)

*Primary Examiner* — Eric Blount
(74) *Attorney, Agent, or Firm* — Van Court & Aldridge LLP

(57) ABSTRACT

A safety system is provided that provides a progressive series of notifications to wirelessly tethered devices based on distance and/or elapsed time criteria when one of the devices physically moves outside of comfort zone set by the other device.

20 Claims, 14 Drawing Sheets

(56) References Cited

U.S. PATENT DOCUMENTS

| | | | | |
|---|---|---|---|---|
| 2016/0335876 | A1* | 11/2016 | Verma ..... | G08B 13/1427 |
| 2020/0092681 | A1 | 3/2020 | Shapiro et al. | |
| 2020/0162843 | A1 | 5/2020 | Bolen et al. | |

* cited by examiner

PARENT AND CHILD PAIRED SAFETY DEVICES AND METHOD OF USE THEREOF

BACKGROUND

Technologies for tracking and monitoring humans for location-based services have become increasingly important in a changing, unpredictable and sometimes dangerous world. For example, caregivers of young children, adults with memory loss, children or adults with autism, children on field trips, individuals with impaired mental capacity, and the like, need to track and monitor the location of their dependents to ensure the dependent is within the approved area(s) and/or has not gotten too far from the caregiver or facility. However, the current tracking and monitoring technologies typically include locator devices that are generally large, consume large quantities of power and are costly. Additionally, these locator devices are generally reactive and alert a caregiver of the location of their dependents after the dependent has wandered away or eloped.

What is desired is a safety system that will immediately alert the caregiver when the dependent has strayed too far from the caregiver, approved area(s), and/or facility, provide the specific or general location of their dependents, and also provides a training mechanism that teaches the dependent to respond to their caregiver and/or learn to return to the caregiver, facility or designated "safe" area on their own.

SUMMARY

A safety system is provided that provides a series of notifications to wirelessly tethered devices based on distance and/or elapsed time criteria when one of the devices physically moves outside of a comfort zone set by the other device.

In one embodiment, a system for generating alerts is provided. The system can include a parent device comprising a first processor and a first transceiver and a child device comprising a second processor and a second transceiver operative to wirelessly communicate with the first transceiver. The first processor is operative to repeatedly determine a distance between the parent device and the child device. When the distance is equal to or exceeds a comfort distance range: the first processor can initiate a timer, initially set an alarm count to one, and continue to run the timer while the distance exceeds the comfort distance range. If the timer exceeds a product of the alarm count and a predetermined period of time, the alarm count can be set to a minimum of 1) the alarm count plus one and 2) a maximum alarm count. An alarm group selected from of a plurality of alarm groups to trigger based on the alarm count, wherein each of the plurality of alarm groups corresponds to a respective elapsed time range, and wherein the plurality of alarm groups are characterized as exhibiting progressively increased alert levels commensurate with an increase in elapsed time. When the distance is less than the comfort distance range, the first processor can reset the timer and reset the alarm count to zero. The first processor can instruct the child device to trigger the selected alarm group by sending an alarm instruction to the child device via the first transceiver, the alarm instruction including the selected alarm group. The second processor is operative to receive the alarm instruction, via the second transceiver, from the parent device, and activate the selected alarm group.

In one embodiment, a system for generating alerts is provided. The system can include a parent device including a first processor and a first transceiver, and a child device including a second processor and a second transceiver operative to wirelessly communicate with the first transceiver. The first processor is operative to repeatedly determine a distance between the parent device and the child device. When the distance exceeds a comfort distance range, the first processor can initiate a timer, continue to run the timer while the distance exceeds the comfort distance range, and reset the timer when the distance is less than or equal to the comfort distance range. The first processor can select an alarm group from of a plurality of alarm groups to trigger based on an elapsed time derived from the timer, wherein each of the plurality of alarm groups corresponds to a respective elapsed time range, and wherein the plurality of alarm groups are characterized as exhibiting progressively increased alert levels commensurate with an increase in the elapsed time, and instruct the child device to trigger the selected alarm group by sending an alarm instruction to the child device via the first transceiver, the alarm instruction including the selected alarm group. The second processor is operative to receive the alarm instruction, via the second transceiver, from the parent device, and activate the selected alarm group.

In one embodiment, the first processor is operative to send a cease alarm instruction to the child device via the first transceiver when the alarm count is reset to zero; and wherein the second processor is operative to cease activating the selected alarm group in response to receiving, via the second transceiver, the cease alarm instruction.

In one embodiment, the first processor is operative to analyze at least one characteristic of a wireless signal being transmitted between the parent device and the child device to determine the distance.

In one embodiment, the plurality of alarm groups includes first, second, third, and fourth alarm groups, wherein the first alarm group comprises a visual alarm, wherein a second alarm group comprises a sensory alarm and the visual alarm, wherein the third alarm group comprises a first auditory alarm, the sensory alarm, and the visual alarm, and wherein the fourth alarm group comprises a second auditory alarm, the sensory alarm, and the visual alarm.

In one embodiment, the first auditory alarm is emitted at a first decibel level and the second auditory alarm is emitted at a second decibel level, wherein the second decibel level is greater than the first decibel level.

In one embodiment, the first auditory alarm and second auditory each include an auditory sound, a voice recording, or a combination thereof.

In one embodiment, the first, second, third, and fourth alarm groups correspond to respective first, second, third, and fourth elapsed time ranges, wherein the first elapsed time range includes a timer start time to a first elapsed time, wherein the second elapsed time range includes elapsed time after the first elapsed time to a second elapsed time, wherein the third elapsed time range includes elapsed time after the second elapsed time to a third elapsed time, and wherein the fourth time range includes elapsed time after the third elapsed time.

In one embodiment, the child device is turned ON and OFF solely at the control of the parent device.

In one embodiment, the first processor is operative to receive via a user input the comfort distance range.

In one embodiment, a method for monitoring spatial distances between a first device and a second device is provided. The method can include determining a normalized signal strength value between the first device and the second device; when the normalized signal strength value is greater than or equal to a safety perimeter signal strength value:

resetting a time counter to zero and resetting an alarm count to zero; and when the normalized signal strength value is less than safety perimeter signal strength value: incrementing the time counter. If the time counter is greater than or equal to a first number: resetting the time counter to zero, setting the alarm count to a minimum of 1) the alarm count plus one and 2) a maximum alarm count, and reverting to the determining. If the time counter is equal to a second number, delaying for a first period of time before reverting to the determining, wherein the second number is less than the first number; and if the time counter is not equal to the second number, delaying for a second period of time before reverting to the determining, wherein the second period of time is greater than the first period of time. An alarm group selected from of a plurality of alarm groups based on the alarm count, wherein each of the plurality of alarm groups corresponds to a respective elapsed time range, and wherein the plurality of alarm groups are characterized as exhibiting progressively increased alert levels commensurate with an increase in elapsed time; and activating the selected alarm group in at least one of the first and second devices.

In one embodiment, when the alarm count is greater than or equal to one: indicating via a user interface in at least one of the first and second devices that the child device is getting closer when a current normalized signal strength value is greater than or equal to a preceding normalized signal strength value, and indicating via the user interface in at least one of the first and second devices that the child device is not getting closer when a current normalized signal strength value is less than the preceding normalized signal strength value.

In one embodiment, each of the plurality of alarm groups comprises at least one type of alarm selected from a visual alarm type, a sensory alarm type, and an auditory alarm type.

In one embodiment, a first subset of the plurality of alarm groups comprises only one type of alarm selected from a visual alarm type, a sensory alarm type, and an auditory alarm type, and wherein a second subset of the plurality of alarm groups comprises multiple alarm types selected from the visual alarm type, the sensory alarm type, and the auditory alarm type.

In one embodiment, the normalized signal strength value is a normalized received signal strength indicator value.

In one embodiment, the method further includes selecting the safety perimeter signal strength value from a plurality of different safety perimeter signal strength values, wherein the selecting is performed in response to a user input or in response to a determination of a location of the parent device. In some embodiments, a default perimeter is used.

In one embodiment, a method for monitoring spatial distances between a first device and a second device is provided. The method includes periodically determining a distance between the first device and the second device; initiating a timer when the distance exceeds a comfort distance range; identifying an alarm zone of a plurality of alarm zones located outside of the comfort distance range that the distance is associated with, wherein each of the plurality of alarm zones has an upper distance limit and a lower distance limit; selecting an alarm group from of a plurality of alarm groups based on one of (1) an elapsed time derived from the timer and (2) the identified alarm zone, wherein each of the plurality of alarm groups corresponds to a respective elapsed time range and to one of the plurality of alarm zones, and wherein the plurality of alarm groups are characterized as exhibiting progressively increased alert levels commensurate with an increase in the elapsed time or an increase in the distance between the first device and the second device; and activating the selected alarm group in at least one of the first and second devices.

In one embodiment, the method further specifies selecting the alarm group from a plurality of alarm groups based on one of (1) an elapsed time derived from the timer or (2) the identified alarm zone, enables an appropriate one of the plurality alarm groups to be activated when conditions associated with the elapsed time are met but conditions associated with the plurality of alarm zones are not met, or when conditions associated with the plurality of alarm zones are met but conditions associated with the elapsed time are not met.

In one embodiment, the method further specifies resetting the timer when the distance is less than or equal to the comfort distance range, and deactivating the selected alarm group when the distance is less than or equal to the comfort distance range.

In one embodiment, the method further specifies determining that the distance between the first device and the second device is decreasing and that the distance still exceeds the comfort distance range, and instructing at least one of the first device and the second device to issue a positive alert indicating that a user of the at least one of the first device and the second device is moving closer to within the comfort distance range.

In one embodiment, the method further specifies analyzing at least one characteristic of a wireless signal being transmitted between the first device and the second device to determine the distance.

In one embodiment, the method further includes initiating a search feature, via the first device or the second device, independent of whether the distance between the first device and the second device exceeds the comfort distance range.

In one embodiment, the method further specifies that the plurality of alarm groups comprises first, second, third, and fourth alarm groups, wherein the first alarm group comprises a visual alarm, wherein a second alarm group comprises a sensory alarm and the visual alarm, wherein the third alarm group comprises a first auditory alarm, the sensory alarm, and the visual alarm, and wherein the fourth alarm group comprises a second auditory alarm, the sensory alarm, and the visual alarm.

In one embodiment, the method further specifies that each of the plurality of alarm groups comprises at least one type of alarm selected from a visual alarm type, a sensory alarm type, and an auditory alarm type.

In one embodiment, the method further specifies that the first subset of the plurality of alarm groups comprises only one type of alarm selected from a visual alarm type, a sensory alarm type, and an auditory alarm type, and wherein a second subset of the plurality of alarm groups comprises multiple alarm types selected from the visual alarm type, the sensory alarm type, and the auditory alarm type.

In one embodiment, another method for monitoring spatial distances between a first device and a second device is provided. The method includes periodically determining a distance between the first device and the second device; identifying an alarm zone of a plurality of alarm zones located outside of a user defined comfort distance range that the distance is associated with, wherein each of the plurality of alarm zones has an upper distance limit and a lower distance limit relative to the first device or the second device; selecting an alarm group from of a plurality of alarm groups based on the identified alarm zone, wherein each of the plurality of alarm groups corresponds to one of the plurality of alarm zones, and wherein the plurality of alarm groups are characterized as exhibiting progressively increased alert levels commensurate with an increase in the distance between the first device and the second device; and activating the selected alarm group in at least one of the first and second devices.

In one embodiment, the method further specifies that the plurality of alarm zones are automatically configured based on a user defined comfort distance range or an artificial intelligence defined comfort distance.

In one embodiment, the method further specifies that a first subset of the plurality of alarm groups comprises only one type of alarm selected from a visual alarm type, a sensory alarm type, and an auditory alarm type, and wherein a second subset of the plurality of alarm groups comprises multiple alarm types selected from the visual alarm type, the sensory alarm type, and the auditory alarm type.

BRIEF DESCRIPTION OF THE DRAWINGS

Advantages of the subject matter claimed will become apparent to those skilled in the art upon reading this description in conjunction with the accompanying drawings, in which like reference numerals have been used to designate like elements, and in which:

DETAILED DESCRIPTION OF THE DISCLOSURE

Figure 1:
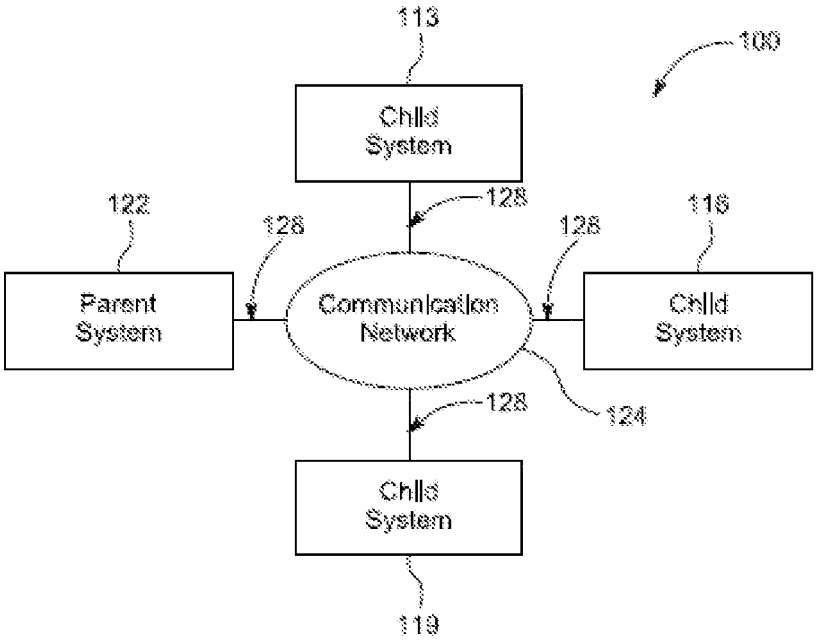
FIG. 1 is a simplified block diagram of a distributed computer network according to an embodiment.

In some embodiments, the safety system described herein, provides a unique way of alerting and notifying a caregiver (referred as a "parent" hereinafter) and dependent(s) (referred as a "child" hereinafter) when the distance between the two exceeds a pre-set distance (referred as a "comfort distance," a "safety perimeter," "comfort zone," "safety distance perimeter," "comfort safety distance," and the like) or exceeds a pre-set area (referred as a "comfort area" hereinafter). The safety system includes at least one device worn or used by the parent (referred as a "parent device" hereinafter) and at least one device worn or used by the child (referred as a "child device" hereinafter) that are paired wirelessly with each other. The parent and/or the child devices can be represented as a wristband, a clip-on for clothes, button, bracelet, anklet, watch, a pendant, built into an article of clothing (e.g. hat, socks, etc.), an application on another device (e.g. smart phone, tablet, etc.) or the like. The child device is authenticated or authorized using a unique code, password, or security protocol. Once the child device is authenticated or authorized, the parent device can communicate with the child device. The parent device can periodically measure the distance between the parent device and the child wearing the child device and/or use existing communication networks to determine the location of a child within a designated area. When a child wearing and/or using the child device exceeds the range set by the comfort distance from the parent's device or comfort area as designated by the parent, an alarm or alarms may be activated on the parent and/or child devices. The number of alarms (e.g. visual, tactile, audio, custom alarms) and/or the level of alarm may increase the longer the child is outside the comfort distance or comfort area and/or the further the child ranges from the comfort distance and/or comfort area. The level of alarm may be indicated using a variety of methods, including but not limited to increasing the number of alarms (e.g. visual only to audio plus visual), or by increasing the intensity of one of more alarms (e.g. more lights, blinking lights, brighter lights, additional light colors, louder audio, etc.).

The parent device may also be used to determine the relative distance and direction between the parent and child devices, or the parent device can determine specific distance and direction if such information is available. The parent may use this "search" feature to determine the general location of their child. The child device can also activate one or more alarms to alert the child the parent is looking for them. The child device can also activate the search feature. The child device alarms may also be used by the parent to locate the child by listening for the child audio alarms or seeing the visual alarms. The direction and/or distance may be given using a variety of methods including but not limited to visual indicators such as number and/or intensity of lights, LCD or other display options, via audio indicators varying sound frequency, frequency of a single sound (pings) or voice alerts, and/or tactile alerts where the intensity and/or frequency of vibrations is adjusted to indicate direction and/or distance, and/or a visual map displayed on a mobile application. The child device may also be capable of activating the distance and direction indicator on the parent device. This may be used when the child wishes the parent to come and find them. The parent device can activate alert(s) to notify the parent the child wants to be located by the parent in addition to direction and distance alerts. This search feature can be implemented independent of where the child device is located with respect to the comfort distance. For example, even if the child device is located within the comfort distance, but the child or parent cannot see the parent or child, respectively, the search feature can be activated to assist the child and parent in locating each other.

Both parent and child devices can alert if the devices are no longer in communication. This may be due to weak signals between the two devices (e.g. devices are too far apart, signal is attenuated or shielded by surrounding obstructions, etc.), device malfunction, device is no longer powered on, etc. Both devices can automatically reinstate pairing when the signal strength is back within operating range.

The parent and child devices may also include a timer function. When the timer function is used, the device can count down the time and initiate an alert or multiple alerts to notify the child and parent when the timer has elapsed. This may be used to help a child with transition from activities, such as, end of play, end of nap time, toilet training, etc. The timer may also be used to "snooze" alarms for a set amount of time.

A timer function may also be used in combination with measured distance between the parent device and child device to alarm the appropriate alarm.

The devices may also include additional sensors including but not limited to accelerometers, gyroscopes, magnetometers, audio sensors, microphones, temperature sensors, and/or IR sensors. These sensors may be active or passive.

The devices may also interact with other devices such as smart phones, smart home devices (e.g. Alexa, FireTV, Google Home, August, Ring, Nest, etc.), communication networks (e.g. Bluetooth beacons, Wi-Fi, etc.) to trigger an activity or event on the parent and/or child devices or on the other device. For example, in some embodiments, the parent device can be smart phone or a smart home device. The safety system device described herein may be used in conjunction with other devices such as phones, smart home devices, external sensors, communication systems, etc. or application on external devices. When in use with other equipment or devices, the safety system devices may trigger an event or activity on the other device(s) or the other device(s) may trigger an event or activity on the safety system device(s).

The parent device may be capable of producing many visual, audio, or tactile (i.e., sensory) alerts. These alerts may be used to indicate to the parent when the child is outside of the comfort distance and/or comfort area, the parent is actively looking for the child, the child has requested the parent to find them, the child device is out of communication range from the parent device, the device is has low battery status, etc.

The child device may be capable of producing many visual, audio, or tactile alerts. These alerts may be used to indicate to the child when they are outside of the comfort distance and/or comfort area, the parent is actively looking for them, feedback to the child that their request for the parent to location them has been activated, the child device is out of communication range from the parent device, the device has low battery status, and/or as a reward. A reward may be a pleasant tune, custom voice audio, or interesting light pattern, which is activated to reward desired behavior. The behavior may be when parent device and child device are reunited, when the child device returns within the comfort distance, or when the device is initially activated. The reward may also be initiated by the parent device.

The child device can be used as a learning tool for parents to teach children not to wander too far. Additionally, the child device may help the child learn other desired behaviors. For example, visual indicators indicative of desired actions (e.g., go outside, time to return home, or take medicine) can be displayed on the child's device. Other desired behaviors based on the child's location may be executed. For example, smart home device (de)activation when a child approaches the device.

The one-to-one pairing of the parent device to the child device with a unique code allows only the parent device to deactivate the child's device. Therefore, the only one who can control the child device is the parent device(s) to which the child device is paired. A child cannot deactivate their own device.

An exemplary hardware device in which embodiments discussed herein may be implemented is described in FIG. 1. Those of ordinary skill in the art will appreciate that the elements illustrated in FIG. 1 may vary depending on the system implementation. FIG. 1 is a simplified block diagram of a distributed computer network 100. Computer network 100 includes child systems 113, 116, and 119, and a parent system 122 coupled to a communication network 124 via a plurality of communication links 128. There may be any number of children and parents in a system. Communication network 124 provides a mechanism for allowing the various components of distributed network 100 to communicate and exchange information with each other.

Communication network 124 may itself be comprised of many interconnected computer systems and communication links. Communication links 128 may be hardwire links, optical links, satellite or other wireless communications links, wave propagation links, or any other mechanisms for communication of information. Various communication protocols may be used to facilitate communication between the various systems shown in FIG. 1. These communication protocols may include TCP/IP, HTTP protocols, wireless application protocol (WAP), vendor-specific protocols, customized protocols, Bluetooth, Bluetooth Low Energy (BLE), Near Field Communications (NFC), and others. While in one embodiment, communication network 124 is the Internet, in other embodiments, communication network 124 may be any suitable communication network including a local area network (LAN), a wide area network (WAN), a wireless network, Metropolitan Area Network (MAN), an intranet, a private network, a public network, a switched network, a beacon network, and combinations of these, and the like.

Distributed computer network 100 in FIG. 1 is merely illustrative of an embodiment and is not intended to limit the scope of the disclosure as recited in the claims. One of ordinary skill in the art would recognize other variations, modifications, and alternatives. For example, more than one parent system 122 may be connected to communication network 124. As another example, child systems 113, 116, and 119 may be coupled to communication network 124 via an access provider (not shown) or via some other parent system.

Child systems 113, 116, and 119 typically request information from a parent system which provides the information. For this reason, parent systems typically have more computing and storage capacity than child systems. Embodiment discussed herein may be implemented using a child-parent environment or a cloud-computing environment.

Parent 122 may be responsible for receiving information requests from child systems 113, 116, and 119, performing processing required to satisfy the requests, and for forwarding the results corresponding to the requests back to the requesting child system. For example, in one embodiment, the parent 122 may receive a request for the location information of the child system 113, 116, and 119. The processing required to satisfy the request may be performed by parent system 122 or may alternatively be delegated to other parents connected to communication network 124. In another embodiment, the child systems 113, 116, and 119 may send a request for information regarding signal strength, notifications, alert triggers to the parent system 122. Alternatively, the parent 122 may also send a request for similar information to the children 113, 116, and 119.

The child system 113, 116, and 119 and/or parent system 122 may utilize user interfaces associated with the systems through a mobile device system. The child and/or parent system may include a monitor, screen, cabinet, and keyboard. Cabinet houses familiar computer components, some of which are not shown, such as a processor, memory, mass storage devices, and the like.

Mass storage devices associated with the child or parent may include flash and other nonvolatile solid-state storage (e.g., USB flash drive), battery-backed-up volatile memory, reader, and other similar media, and combinations of these.

A computer-implemented or computer-executable version of the embodiments may be embodied using, stored on, or associated with computer-readable medium or non-transitory computer-readable medium. A computer-readable medium may include any medium that participates in providing instructions to one or more processors for execution. Such a medium may take many forms including, but not limited to, nonvolatile, volatile, and transmission media. Nonvolatile media includes, for example, flash memory, or optical or magnetic disks. Volatile media includes static or dynamic memory, such as cache memory or RAM. Transmission media includes coaxial cables, copper wire, fiber optic lines, and wires arranged in a bus. Transmission media can also take the form of electromagnetic, radio frequency, acoustic, or light waves, such as those generated during radio wave and infrared data communications.

For example, a binary, machine-executable version, of the software of various embodiments may be stored or reside in RAM or cache memory, or on mass storage device. The source code of the software may also be stored or reside on mass storage device (e.g., hard disk, magnetic disk, tape, or CD-ROM). As a further example, code may be transmitted via wires, radio waves, or through a network such as the Internet.

Figure 2:
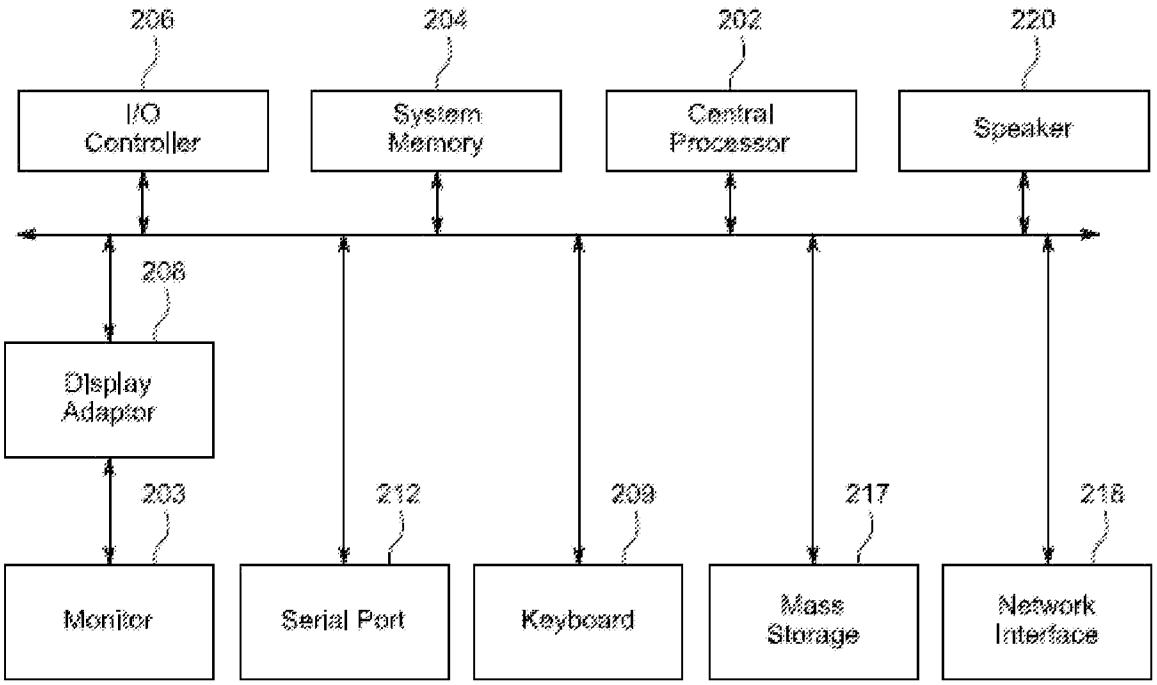
FIG. 2 illustrates a system block diagram of a computing device used in the safety system according to an embodiment.

FIG. 2 shows a system block diagram of a computer system, such as the child or parent systems. The computer system may include a monitor 203, keyboard 209, and mass storage devices 217. Computer system 201 may further include subsystems such as central processor 202, system memory 204, input/output (I/O) controller 206, display adapter 208, serial or universal serial bus (USB) port 212, network interface 218, and speaker 220. In an embodiment, a computer system includes additional or fewer subsystems. For example, a computer system could include more than one processor 202 (i.e., a multiprocessor system) or a system may include a cache memory.

Arrows, as illustrated in FIG. 2, represent the system bus architecture of computer system 201. However, these arrows are illustrative of any interconnection scheme serving to link the subsystems. For example, speaker 220 could be connected to the other subsystems through a port or have an internal direct connection to central processor 302. The processor may include multiple processors or a multicore processor, which may permit parallel processing of information. Computer system 201 shown in FIG. 2 is but an example of a suitable computer system. Other configurations of subsystems suitable for use will be readily apparent to one of ordinary skill in the art.

Computer software products may be written in any of various suitable programming languages, such as C, C++, C#, Pascal, Fortran, Perl, Matlab (from MathWorks), SAS, SPSS, JavaScript, AJAX, Java, SQL, and XQuery (a query language that is designed to process data from XML files or any data source that can be viewed as XML, HTML, or both). The computer software product may be an independent application with data input and data display modules. Alternatively, the computer software products may be classes that may be instantiated as distributed objects. The computer software products may also be component software such as Java Beans (from Oracle Corporation) or Enterprise Java Beans (EJB from Oracle Corporation). In a specific embodiment, the various embodiments provide a computer program product which stores instructions such as computer code to program a computer to perform any of the processes or techniques described.

An operating system for the system may be one of the Microsoft Windows® family of operating systems (e.g., Windows 95, 98, Me, Windows NT, Windows 2000, Windows XP, Windows XP x64 Edition, Windows Vista, Windows 7, Windows CE, Windows Mobile), Linux, HP-UX, UNIX, Sun OS, Solaris, Mac OS X, Alpha OS, AIX, IRIX32, or IRIX64. Other operating systems may be used. Microsoft Windows is a trademark of Microsoft Corporation.

Furthermore, the computer may be connected to a network and may interface to other computers using this network. The network may be an intranet, internet, or the Internet, among others. The network may be a wired network (e.g., using copper), telephone network, packet network, an optical network (e.g., using optical fiber), or a wireless network, or any combination of these. For example, data and other information may be passed between the computer and components (or steps) of the system using a wireless network using a protocol such as Wi-Fi (IEEE standards 802.11, 802.11a, 802.11b, 802.11e, 802.11g, 802.11i, and 802.11n, just to name a few examples). For example, signals from a computer may be transferred, at least in part, wirelessly to components or other computers.

In an embodiment, with a Web browser executing on a computer workstation system such as a mobile device, a user accesses a system on the World Wide Web (WWW) through a network such as the Internet. The Web browser is used to download web pages or other content in various formats including HTML, XML, text, PDF, and postscript, and may be used to upload information to other parts of the system. The Web browser may use uniform resource identifiers (URLs) to identify resources on the Web and hypertext transfer protocol (HTTP) in transferring files on the Web.

The safety system embodiments discussed herein can include at least two devices, a parent device and a child device. The parent device is paired to the child device so that the two devices may communicate. In one embodiment, the parent device may be paired to a plurality of child devices. In another embodiment, multiple parent devices may be paired to a single or plurality of child devices, such that an alarm may be triggered on each parent device along with each child device. Optionally, each of the multiple parent devices may have equal control over the child devices or only one of the multiple parent devices may have control over the child devices.

When the parent device is paired with the child device, the child device may periodically exchange a unique code or password with the parent device in an authentication and/or authorization process. The authentication process ensures and confirms the child device's identity whereas the authorization verifies the child device has correct permissions and rights to transmit or receive information from the parent device. Although in this embodiment, a password only authentication or authorization is being used, other technologies may be used to verify, secure, validate, or confirm communication access between the child device and parent device. This level of security ensures that no other device than the paired parent device can activate/deactivate child device(s) functionality.

In one embodiment, each time the parent device and the child device exchange the unique code or password, the parent device measures a distance between the parent device and the child device. In another embodiment, the parent device may measure the distance periodically without first having to authenticate or authorize the child device using the unique code or password. The parent device can measure the relative distance between the parent and child devices by the strength of the radio wave signal between the parent and child devices. For example, the parent device receives a signal strength indicator (RSSI) to determine the strength of the radio wave between the parent device and the child device. Signal strength can be correlated to a relative distance, however, signal strength may be attenuated by environmental or external factors. It is understood that further references to distance may by synonymous to signal strength in addition to an actual length.

RSSI is an indication of the power level being received by the receive radio after the antenna and possible cable loss. Therefore, the higher the RSSI number, the stronger the signal. Thus, when an RSSI value is represented in a negative form (e.g. −100), the closer the value is to 0, the stronger the received signal has been.

RSSI can be used internally in a wireless networking card to determine when the amount of radio energy in the channel is below a certain threshold at which point the network card is clear to send (CTS). Once the card is clear to send, a packet of information can be sent. The end-user will likely observe a RSSI value when measuring the signal strength of a wireless network through the use of a wireless network monitoring tool like Wireshark, Kismet or Inssider. As an example, Cisco Systems cards have a RSSI Max value of 100 and will report 101 different power levels, where the RSSI value is 0 to 100. Another popular Wi-Fi chipset is made by Atheros. An Atheros based card will return an RSSI value of 0 to 127 (0x7f) with 128 (0x80) indicating an invalid value.

In another example, a received channel power indicator (RCPI) may be used to determine the strength of the radio frequency. For example, RCPI is an 802.11 measure of the received RF power in a selected channel over the preamble and the entire received frame, and has defined absolute levels of accuracy and resolution. RCPI is exclusively associated with 802.11 and as such has some accuracy and resolution enforced on it through IEEE 802.11k-2008. Received signal power level assessment is a necessary step in establishing a link for communication between wireless nodes. However, a power level metric like RCPI generally cannot comment on the quality of the link like other metrics such as travel time measurement (ToA).

In other embodiments, different methods known in the art for determining location distance between two devices may be used. For example, Bluetooth technology, including the Bluetooth 5.1 protocol, which includes native distancing metrics, may be used. Global positioning systems (GPS), RFID radars, and near field communication (NFC) technology are examples of other but less preferred methods for determining distance in accordance with embodiments discussed herein.

The parent/child safety system is designed to alert a caretaker and a child when a distance between the caretaker and child exceeds a comfort distance. The comfort distance can be quantified in "human scale" terms that are typically associated with line of sight distances. For example, in a park setting, a comfort distance may be on the order of 100-400 feet. In an enclosed space setting such as a warehouse store, a department store, or a mall, the comfort distance may be on the order 20-50 feet. These types of distances are better suited to be determined using wireless technology such as 802.11, 802.15.4, or Bluetooth. GPS systems do not work indoors and are subject to interference issues in dense urban areas. NFC and RFID are meant for relatively short distances of a meter or less and are not well suited for "human scale" distances being used by embodiments used herein.

The comfort distance is a predetermined distance range from the parent device which is considered a safe zone. The comfort distance may represent a radial distance from the parent device, and the zone that falls within the radial distance can be referred to as the comfort zone or comfort area. A parent may set the comfort distance to a specific number (e.g., 50 feet) or can select a generic category such as close, nearby, and far by interacting with a user interface on the parent device. As an alternative, the generic category can include different environments such as "inside" to represent interior space environments such as stores or "outside" to represent open space environments such as parks or playgrounds. Selection of a generic category may automatically set the comfort distance to an appropriate distance. For example, selection of "close" may set the comfort distance to 25 feet, selection of "nearby" may set the comfort distance to 100 feet, and selection of "far" may set the comfort distance to 300 feet. The comfort distance may be designated by a range of acceptable signal strengths if user designated comfort distance is not specified.

The comfort distance can serve as a trigger point for activating one or more alarms in accordance with embodiments discussed herein. As will be explained in more detail below, when the child device moves outside of the comfort distance range/area, different criteria are evaluated to determine the appropriate level of alarming to activate. The safety system is designed to progressively alert the child and/or parent of a breach of the comfort distance based on elapsed time spent outside the comfort distance, location of the child device within one of several alarm (distancing) zones outside of the comfort distance, and/or the change in progress from alarm zone to alarm zone (e.g., child moves closer to parent in response to alarm). In one approach, it may be inferred that the longer the child device is located outside of the comfort distance, that the child has moved farther away from the parent. Different alarms may be activated based on the elapsed time the child device is detected outside of the comfort distance area. In another approach, as the child device moves farther away from the parent device, different alarms may be activated based on how far the child device has moved away from the parent device. In another approach, as the child device moves closer to the parent device, different alarms may be activated based on how close the child device is coming to the parent device.

In some embodiments, if information regarding an area of concern is available (e.g. egress locations), the devices may alarm if the child device is determined to have passed through or is too close to the area of concern.

Figure 2A:
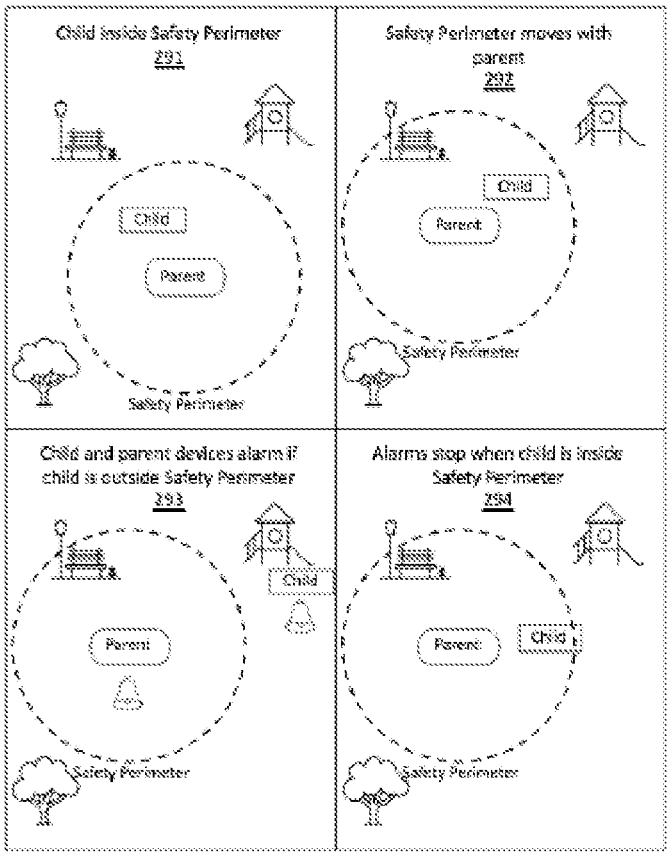
FIG. 2A shows an illustrative diagram of different scenarios between a child device and a parent device according to an embodiment.

FIG. 2A shows an illustrative diagram of different scenarios between a child device and a parent device according to an embodiment. Each scenario shows a child device, a parent device, and a safety perimeter. The safety perimeter is akin to the comfort distance. Scenario 291 shows that the child device is located within the safety perimeter set by the parent device, and that no alarms are activated. Scenario 292, which is contrasted to scenario 291, shows that the safety perimeter moves when the parent device is moved. The child device is located within the safety perimeter and therefore no alarms are activated. Scenario 293 shows that the child device has moved outside of the safety perimeter and an alarm is activated as a result. Scenario 294 shows that the child device has moved back within the safety perimeter, thereby resulting in deactivation of any alarms.

Figure 3A:
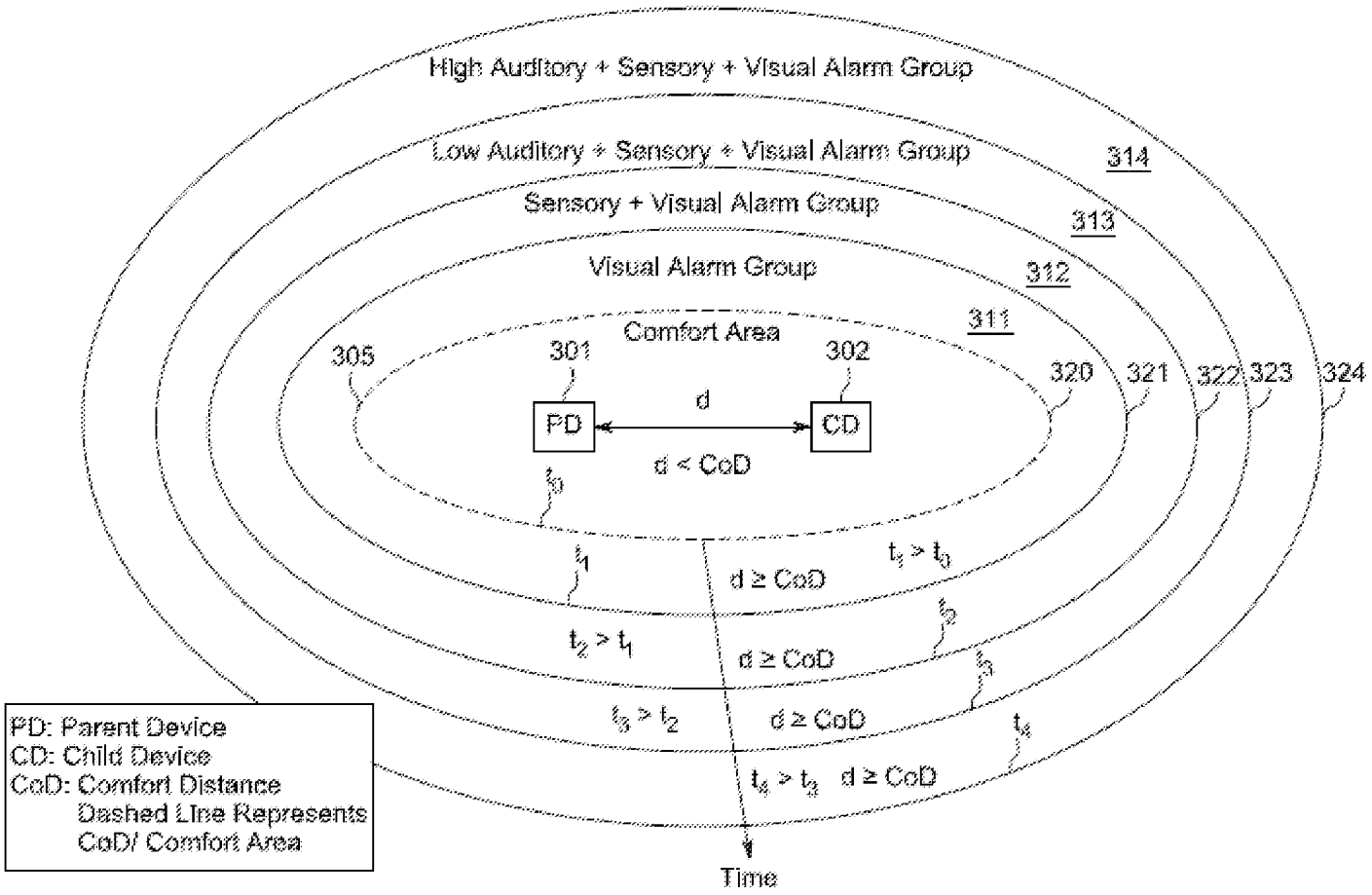
FIG. 3A shows an illustrative diagram of different alarm groups that are activated based on elapsed time a child device is located outside of comfort distance area according to an embodiment.

FIG. 3A shows an illustrative diagram of different alarm groups that are activated based on elapsed time a child device is located outside of comfort distance area according to an embodiment. FIG. 3A shows parent device (PD) 301, child device (CD) 302, comfort distance range 305, and four illustrative alarm groups 311-314, delineated by elapsed time rings 320-324. Comfort distance range 305 may be based on a user defined comfort distance, a default comfort distance, or an artificial intelligence defined comfort distance. The comfort distance can be automatically adjusted or manually adjusted by a user after the comfort distance has been initially set. An artificial intelligence or machine learning can be applied to distance measurements and analytics thereof can be used to set the comfort distance. Each of alarm groups corresponds to a respective elapsed time range. PD 301 may start a timer when the distance between PD 301 and CD 302 meets or exceeds the comfort distance. This timer controls the elapsed time that CD 302 remains outside of comfort distance range 305. As shown, group 311 corresponds to elapsed time range t0-t1, group 312 corresponds to elapsed time rage t1-t2, group 313 corresponds to elapsed time range t2-t3, and group 314 corresponds to elapsed time range t3-t4, where t4>t3>t2>t1>t0.

Alarm groups 311-314 are characterized as exhibiting progressively increased alert levels commensurate with an increase in the elapsed time. Each one of alarm groups 311-314 can include at least one type of alarm selected from a visual alarm type, a sensory alarm type, and an auditory alarm type. The visual alarm may be any visual indicator, such as flashing lights, different color lights, different icons being displayed on child device 302, and the like. A sensor alarm can be the vibration, changes of temperature, and the like of child device 302. Auditory alarms can include any auditory noise at relatively low or high volume levels, depending on the elapsed time. The actual sound can include beeps, siren, tone, ring, music, generic prerecorded voice messages, or parent prerecorded voice messages.

The composition of alarm groups 311-314 changes depending on which elapsed time range it corresponds to and is proportional to the elapsed time. For example, alarm group 311 may include just one alarm type (e.g., a visual alarm), whereas alarm group 314 may include three different alarm types (e.g., visual, sensory, and auditory alarms). The composition of alarm groups 311-314 may be cumulative in that an alarm group corresponding to a later elapsed time may include the alarm types of any alarm groups corresponding to earlier elapsed times For example, alarm group 312 may include two different alarm types (e.g., a visual alarm and a sensory alarm). Here, alarm group 312 includes the visual alarm of alarm group 311, but adds the sensory alarm. This cumulative approach can extend to alarm groups 313 and 314, which may each include three different alarm types (e.g., visual, sensory, and auditory alarms), but one of the alarm types may be different. For example, alarm group 313 may include a first auditory alarm (e.g., a relatively low volume auditory alarm) and alarm group 314 may include a second auditory alarm (e.g., a relatively high volume auditory alarm).

When an alarm group is selected based on the elapsed time, the alarm(s) pertaining to that group are activated. For example, if child device 302 has been located outside of comfort distance range 305 for an elapsed time falling between times t1 and t2, then alarm group 312 is selected and activated. If multiple alarm types are included in the selected alarm group, child device 302 can active all alarms simultaneously, or can cycle through all alarms.

The alarms may continue to be active until the distance between parent device 301 and child device 302 is less than the comfort distance range. When the distance is less than the comfort distance range, the timer can be stopped and reset. In some embodiments, after an alarm or alarms are already activated, messages of encouragement may be presented on child device 302 when the distance between devices 301 and 302 decreases.

Figure 3B:
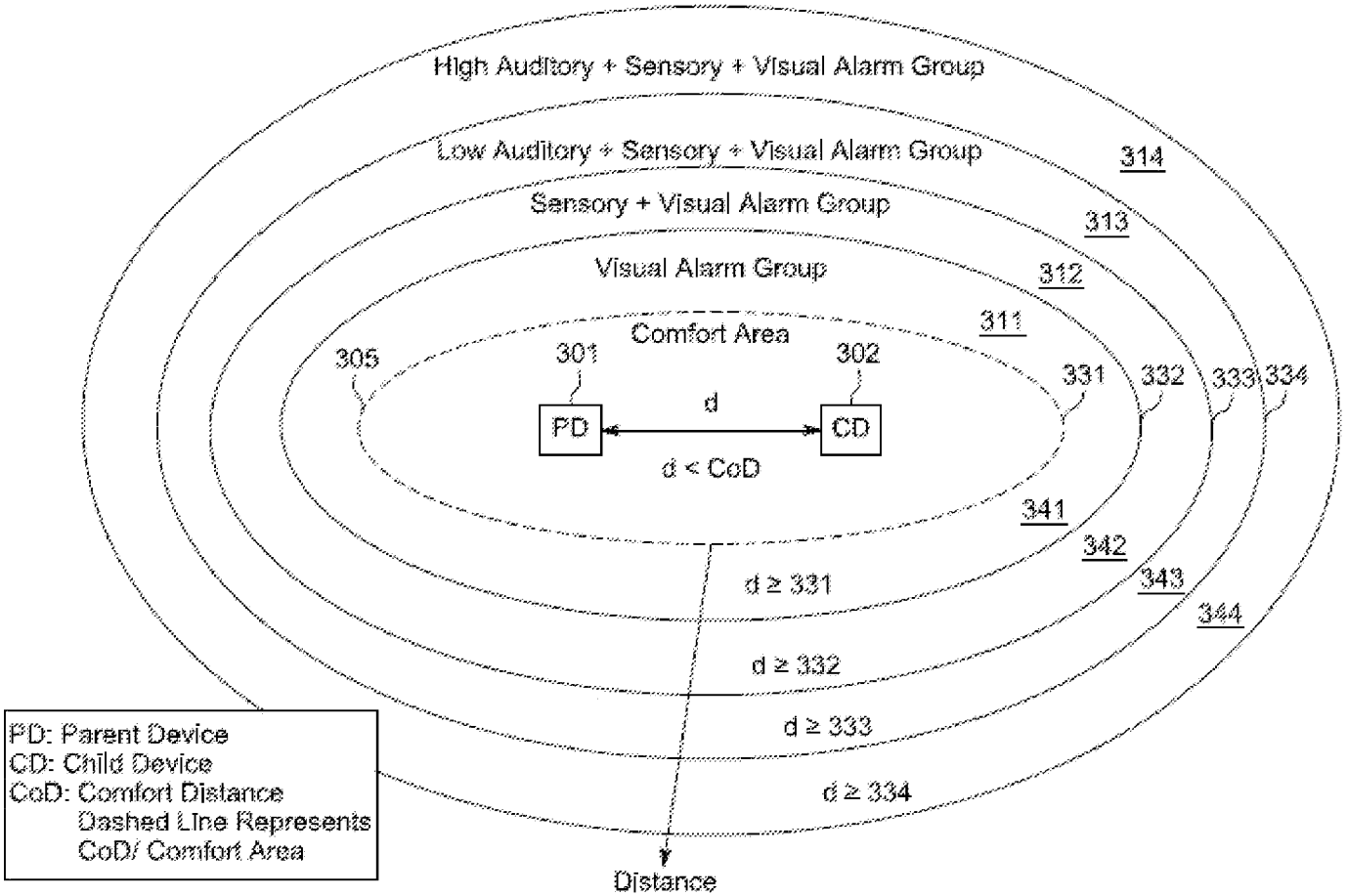
FIG. 3B shows an illustrative diagram of different alarm groups that are activated based on which alarm zone a child device is located according to an embodiment.
Figure 3C:
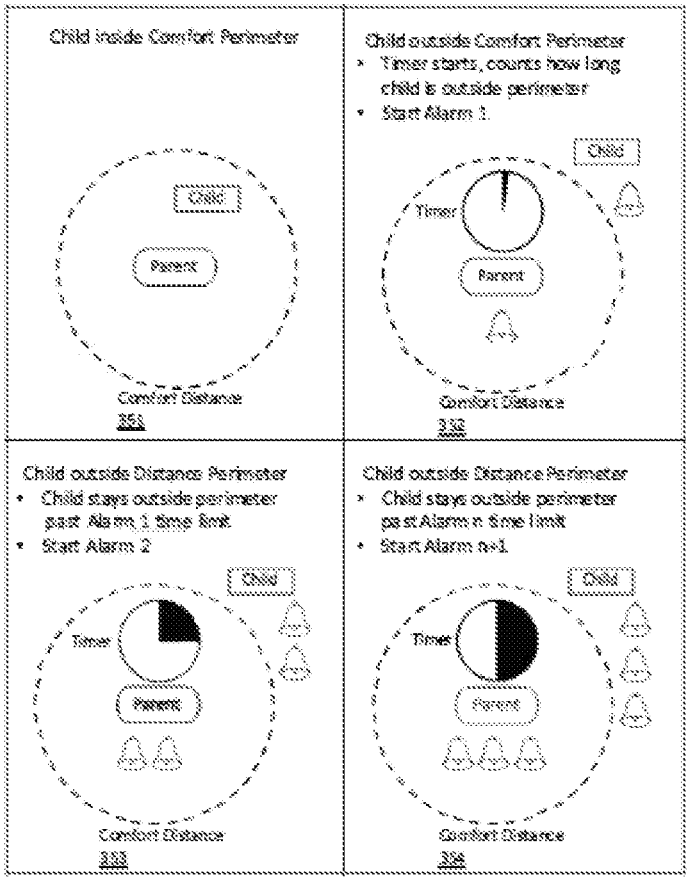
FIG. 3C show several pictographs of different time based alarms according to an embodiment.

FIG. 3C show several pictographs of different time based alarms according to an embodiment. FIG. 3C also represents an alternative representation of FIG. 3A. Scenario 351 shows an alarm state in which the child device is located within the comfort distance perimeter. However, once the child device is detected outside of the comfort distance perimeter, a timer is started and a first alarm is activated, as indicated in scenario 352. If the child remains outside of the comfort distance perimeter for a period of time that exceeds a first alarm time limit, a second alarm is activated, as indicated in scenario 353. If the child continues to remain outside of the comfort distance perimeter for a period of time that exceeds an N alarm time limit, an N+1 alarm may be activated, as indicated in scenario 354. The "N" refers to the currently active alarm.

FIG. 3B shows an illustrative diagram of different alarm groups that are activated based on which alarm zone a child device is located according to an embodiment. FIG. 3B is similar in many respects to FIG. 3A, with the exception that elapsed time rings 320-325 are replaced with alarm zone distance rings 331-334. Alarm zone distance rings 331-334 define alarm zones 341-344. That is, alarm zone 341 exists between rings 331 and 332, alarm zone 342 exist between rings 332 and 333, alarm zone 343 exists between rings 333 and 334, and alarm zone 344 exist outside of ring 334. Alarm zones 341-344 correspond to alarm groups 311-314, respectively. It should be understood that the number of distance rings and alarm zones shown in FIG. 3B are merely illustrative that additional rings and alarm zones may be added or that one or more rings and alarms zones can be omitted.

Alarm zones 341-344 exist outside of comfort distance range 305 and each has an upper distance limit and a lower distance limit relative to one of parent device 301 or child device 302. The upper and lower distance limits are set by rings 331-334. The distance gaps between rings 331-334 may be uniform (i.e., a fixed distance sets the spacing between rings 331-334, or the distance gaps between rings 331-334 may be non-uniform (e.g., distance between rings 331 and 332 may be greater than distance between rings 333 and 334).

Alarm zones 341-344 may be set in response to the selected comfort distance. For example, if comfort distance is set to 30 feet, alarm zones 341-344 use the 30 feet comfort distance as the baseline. For example, alarm zone distance ring 331 can be set to the comfort distance, and alarm zone distance ring 332 can be to the comfort distance plus a fixed number (e.g., 20 feet) or can be set to the product of the comfort distance and a scaler value (e.g., 1.5).

During operation of the safety system, the distance between parent device 301 and child device 302 is periodically determined, and different alarms can be triggered based on the distance. As an example, assume that child device 302 is steadily moving away from parent device 301. When the distance between devices 301 and 302 meets or exceeds distance ring 331, and child device 302 is in alarm zone 341, visual alarm group 311 can be selected and activated. When the distance between devices 301 and 302 meets or exceeds distance ring 332, and child device 302 is in alarm zone 342, visual alarm group 312 can be selected and activated. When the distance between devices 301 and 302 meets or exceeds distance ring 333, and child device 303 is in alarm zone 343, visual alarm group 313 can be selected and activated. When the distance between devices 301 and 302 meets or exceeds distance ring 334, and child device 302 is in alarm zone 344, visual alarm group 314 can be selected and activated.

When the distance between devices 301 and 302 indicates that distance is decreasing from an outer alarm zone (e.g., alarm zone 334) to an inner alarm zone (e.g., alarm zone 333), the selected alarm group can transition from one alarm group (e.g., alarm group 314) to another alarm group (e.g., alarm group 313). In some embodiments, a message of encouragement may be emitted by child device 302 to indicate to the child that he or she is moving the right direction towards parent device 301. When the distance between devices 301 and 302 indicates that distance is less than the comfort distance, all alarms cease.

Figure 3D:
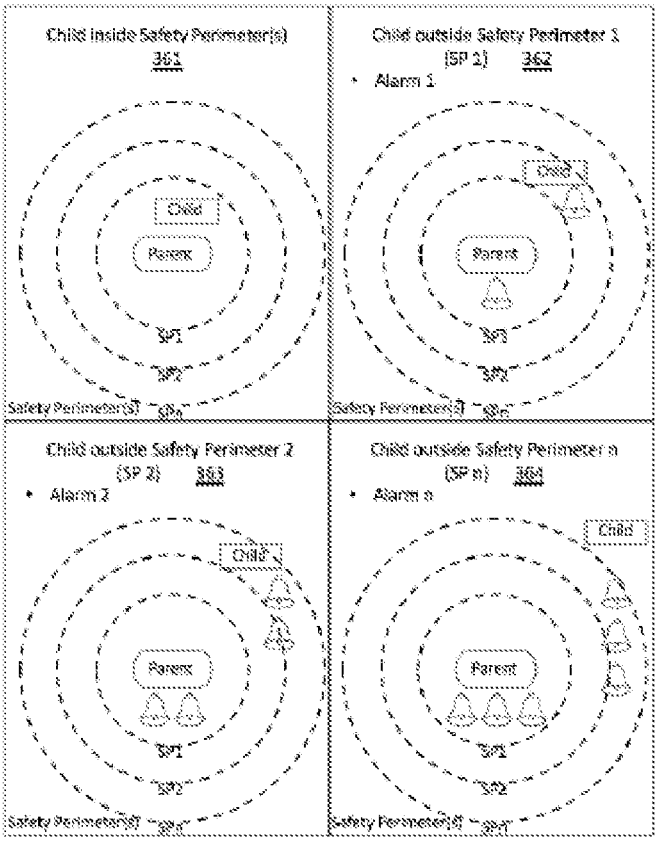
FIG. 3D show several pictographs of different distance based alarms according to an embodiment.

FIG. 3D show several pictographs of different distance based alarms according to an embodiment. FIG. 3D also represents an alternative representation of FIG. 3B. Scenario 361 shows a no alarm state in which the child device is located within the safety distance perimeter. Each of the scenarios in FIG. 3D show different safety perimeters, delineated as SP1, SP2, SPn, etc, where each SP represents a different distance threshold responsible for triggering a different alarm or alarm group. Scenario 362 shows that the child has moved outside of SP1, but not outside of SP2. This results in activation of alarm group 1. Scenario 363 shows that the child has moved outside of SP2, but not outside of SP3. This results in activation of alarm group 2. Scenario 364 shows that the child has moved outside of SPn, but not outside of SP(n+1). This results in activation of alarm group n.

In some embodiments, the safety system can employ (1) the elapsed time based alarming discussed above in connection with FIG. 3A, (2) the alarm zone based alarming discussed above in connection with FIG. 3B, or (3) a hybrid of both elapsed time based alarming and alarm zone based alarming. The hybrid approach enables the safety system to apply more criteria to distance and time measurements to more accurately activate the appropriate alarm groups. For example, assume an example where a child runs away from the parent at his or her top speed. The alarm zone based alarm may result in activation of a more progressive alarm group (e.g., alarm group 314) because the kid has already entered into alarm zone 334, whereas the elapsed time alarm may not cause the more progressive alarm to activate because the elapsed time has not yet reached the elapsed time threshold associated with that more progressive alarm. Parent device 301 may decide which alarm group to activate based on the criteria obtained using both elapsed time and alarm zone methods for triggering alarms. As another example, assume a kid roams outside of the comfort distance range, and "hangs out" in a particular alarm zone (e.g., alarm zone 331) for an extended period of time. Applying the alarm zone criteria, the selected alarm group would remain fixed, though by applying the elapsed time criteria, the selected alarm group will progress to other alarms groups as the elapsed time continues to increase.

In the hybrid approach, the safety system may select the more progressive alarm group rendered by both the elapsed time and alarm zone methods when actions by the child indicate that he or she is remaining outside of the comfort distance range or is continuing to increase his or her distance from the comfort distance range. Even if the child takes action that indicates that he or she is returning to the comfort area, the system may activate the highest level alarm group that satisfies the criteria under the elapsed time or the alarm zone approach. For example, assume that the safety system is alarming at alarm zone 314 because the child is located in alarm zone 334 and because the child has been outside of the comfort distance range for an elapsed time corresponding to alarm zone 314. Even if the child moves from alarm zone 334 to alarm zone 332, alarm group 314 may remain active because the elapsed time criteria is still being met.

Figure 4:
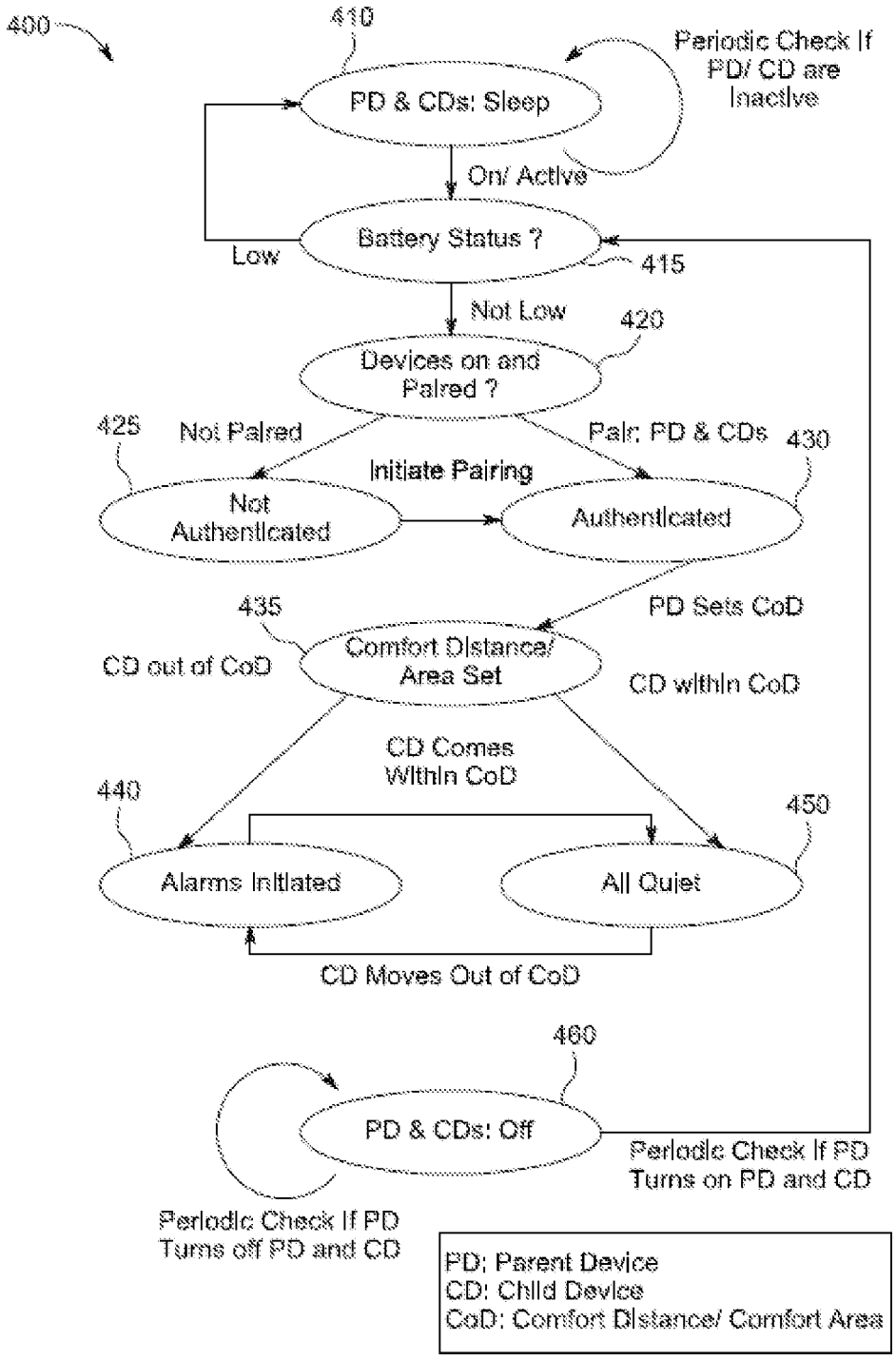
FIG. 4 shows an illustrative process according to an embodiment.

FIG. 4 illustrates process 400 showing operation of the safety system according to an embodiment. Starting at step 410, the PD and CD are in a sleep mode and are periodically checked to determine whether the PD or CD should stay in sleep mode or exit out of sleep mode. To conserve power, the parent and/or child devices may go into a sleep mode when the distance between the devices does not change over an extended period of time and/or if other sensors which may be implemented has determined a period of inactivity. When in sleep mode, the device(s) can periodically check for activity and either remain in sleep mode or return to another accepted mode of operation (e.g. normal mode, reduced power mode, etc.). In one embodiment, while in sleep mode, the distance between the parent device and the child device are continuously or periodically determined. When the distance between the parent device and the child device changes as to denote activity, the devices are turned on. In another embodiment or in addition to the previous embodiment, the user of the parent device may manually turn on the devices. In another embodiment, other inputs from additional sensors may be used to determine device activity and the devices are turned on.

When CD or PD go active, process 400 can determine battery status of the PD and the CD at step 415. If the battery status is LOW, process 400 reverts back to step 410. The parent and child devices also include a low battery indicator. The device(s) may have reduced functionality based on amount of capacity remaining in the battery. If the battery status is NOT LOW, process 400 turns the PD and CD ON at step 420 and determines whether the PD and the CD are paired. If the devices are not paired, process 400 determines that the PD and CD are not authenticated with each other at step 425 and begins a pairing process so that the PD and CD can be authenticated to each other at step 430. If the devices are already paired at step 420, process 400 proceeds directly to step 425. The parent device can include a unique code or password. In one embodiment, the parent device is factory encoded with the unique code or password. When the parent and child devices are turned on and pairing is initiated, the unique code or password associated with the parent device will be copied on the child devices, thereby authenticating or authorizing the child device and parent device.

After the parent device and the child device are paired and authenticated at step 430, the parent device may set a comfort distance range at step 435. In one embodiment the comfort distance range is a predetermined distance or a set of predetermined distances where the user may select one of the predetermined distances. A user of the parent device may alter or change the comfort distance range via a user interface associated with the parent device. In another embodiment, after the child device is authenticated, the parent device may be prompted to input a customized comfort distance range. In another embodiment, the parent may adjust the customize the comfort distance using a mobile-based application. In another embodiment, the parent may set the comfort distance by placing the child device a known distance away from the parent device and setting that distance as the comfort distance.

Once the comfort distance range is set, the distance between the parent device and the child device is determined. If the child device is out of the comfort distance range, an alarm is initiated at step 440. Different alarms may be initiated based on application of the elapsed time approach, the alarm zone approach, or a hybrid thereof.

Since the distance between the parent device and the child device is determined periodically, if the distance between the parent device and the child device changes, different actions may be taken. For example, if the new measured distance from the parent device and the child device is less than the previous measured distance because either the child device moves closer to the parent device or the parent device moves closer to the child device and the new measured distance is now within the comfort distance range, the alarm(s) on the child device deactivate at step 450.

Once the child device alarm (s) is deactivated and a subsequence distance is measured, a determination is made if an alarm is to be triggered on the child device based on the subsequent measured distance and elapsed time (assuming the subsequent measured distance is no longer in the comfort distance range).

In one embodiment, the alarm may be triggered on both the parent device and the child device. In another embodiment, only alarm(s) on the child device are triggered. In another embodiment only alarm(s) on the parent device are triggered. Once an alarm is triggered, the user of the parent device may deactivate the trigger on the parent device, child device or both the parent device and the child device. The parent may deactivate the alarm so that it does not alarm again, or the alarm may be placed into "snooze" mode and reactivate after a set time if the child device has not returned within the comfort distance or comfort area. In one embodiment, the parent device may automatically deactivate the alarm or change the alarm after a certain amount of time. For example, if the alarm has executed for a predetermined amount of time and both the parent device and the child device are stable such that the distance between the parent and child devices has been within the same distance range for the predetermined amount of time, the alarm may be deactivated. If the user of the parent device deactivates the alarm or the alarm is automatically deactivated on the parent device and the child device, the parent device and the child device may be returned to the mode they were in prior to the alarms activating.

The parent device and the child device are paired, as described above. The parent device has total control over the child devices including but not limited to: (1) turn child devices on/off; (2) set a "Comfort Distance" and/or "Comfort Area" between the parent and child devices; (3) initiate distance/direction alarms on child devices, (4) initiate timed alarm(s) on child devices, (5) initiate other available alarms based on sensor data, (6) initiate available learning tools based on sensor data, location services, etc, (7) deactivate child alarms, (8) snooze child alarms. The parent device may also control periodic power cycling of the PD and CD at step 460. In order to save power, the PD may cause both the PD and CD to turn OFF and ON. When the PD turns ON the PD and the CD, process 400 can proceed to step 415.

It should be understood that the steps shown in FIG. 4 are illustrative and that additional steps may be added and that some steps may be omitted.

Figure 5A:
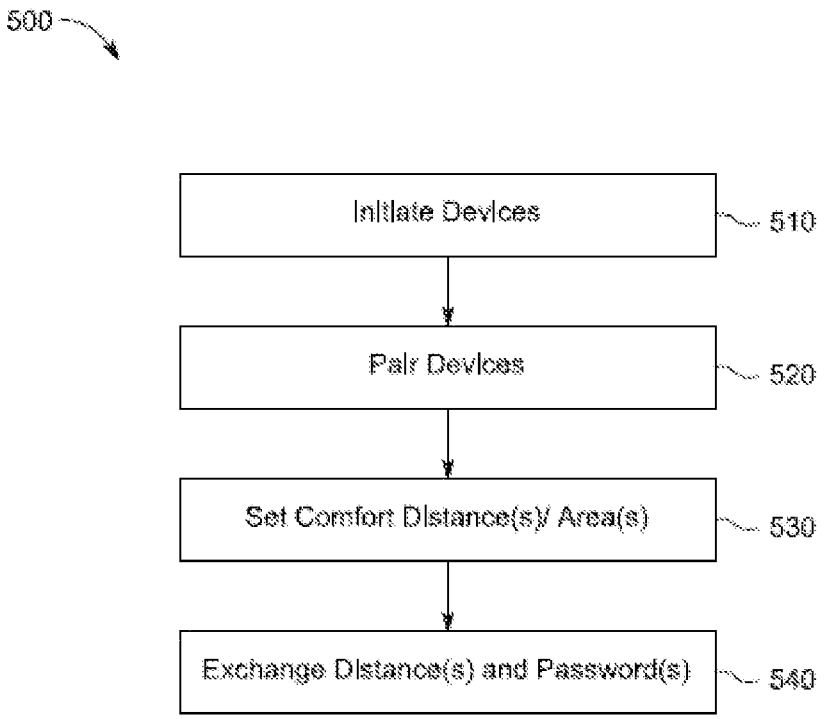
FIG. 5A shows illustrative process according to an embodiment.

FIG. 5A shows illustrative process 500 according to an embodiment. Process 500 can initiate the parent and child devices at step 510. Initiating the devices includes powering on both the parent device and the child device. This may be done automatically or manually by the user of the parent device. When at least one parent device and at least one of the child devices are initiated, the parent device(s) and the child device(s) are paired, at step 520. Pairing the devices allows the devices to communicate with one another. When the parent device(s) and child device(s) are paired, the parent device(s) can establish the setting for the safety system, such as the comfort distance range, at step 530. In one embodiment, the user of the parent device(s) can set different comfort distance ranges for each of the child devices. In another embodiment, the user of the parent device(s) can set the same comfort distance range for all or some of the child devices. In another embodiment, the comfort distance range may be predetermined, so that the user does not need to set the comfort distance range each time the devices are paired.

Optionally, once the comfort distance range is set, the user may also set the number of alarm zones, set the different distance ranges for each alarm zone and/or set the alarm groups associated with the different alarm zones. In one embodiment, the parent device may automatically adjust the different distance ranges associated with each alarm zone based on the comfort distance range. In another embodiment, the comfort distance range, the number of alarm zones, the different distance ranges for each alarm zone, the alarm groups associated with the different alarm zones may be predetermined so that the user of the parent device does not need to program these setting each time the devices are paired.

When the parent device adjusts or establishes the settings as described above, the parent device and child device are authenticated or authorized, at step 540. In one embodiment, authentication or authorization is done by exchanging passwords or unique ID's. Once the devices are authenticated and/or authorized, the distance between the parent device and the child device can be measured. The distance is measured continually, periodically, and/or manually by the user of the parent device.

Figure 5B:
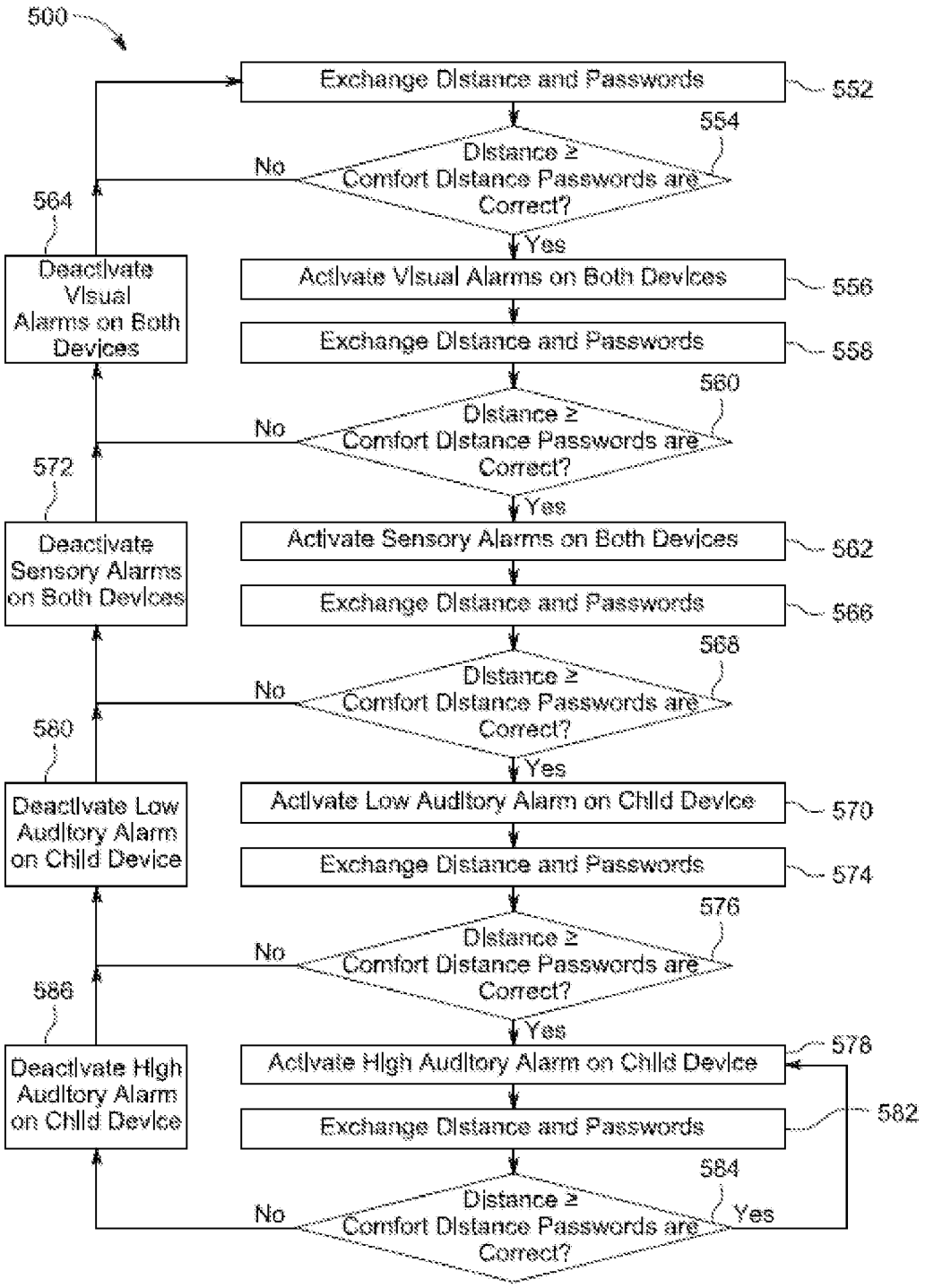
FIG. 5B shows another illustrative process according to an embodiment.

FIG. 5B shows illustrative process 550 according to an embodiment. Process 550 may flow from process 500. That is, process 550 shows that distances and passwords are exchanged multiple times. Each time distances and passwords are exchanged, process 500 may be implemented. Starting with step 552, distance and passwords are exchanged and a determination is made whether the passwords are correct and the distance is equal to or greater than then the comfort distance at step 554. If the determination at step 554 is NO, no action is taken and process reverts back to step 552. If the determination at step 554 is YES, a first alarm is active on the child device. For example, the first alarm may be a visual alarm. In one embodiment, the first alarm is activated on both the child device and the parent device, as shown in step 556.

After the first alarm is activated, a distance between the parent device and the child device is measured again. Optionally, when the distance is measured, the child device and the parent device exchange passwords or unique ID's at step 558. Another distance and password determination is made at step 560.

If the distance measured is greater than or equal to the comfort distance, then a second alarm is triggered at step 562. For example, a sensory alarm may be triggered. The sensory alarm may be combined with the visual alarm that was already activated, or the sensory alarm may replace the alarms that were previously activated. However, if the distance measured most recently is less than the comfort distance, then the parent device deactivates the alarm that was already activated, at step 564. For example, the visual alarm is deactivated.

After step 562, a distance between the parent device and the child device is measured again. Optionally, when the distance is measured, the child device and the parent device exchange passwords or unique ID's, as shown in step 566. Another distance and password determination is made at step 568.

If the distance measured most recently is greater than or equal the comfort distance, then a third alarm is triggered at step 570. For example, a low auditory alarm may be triggered. The low auditory alarm may be combined with the visual alarm and sensory alarm that was already activated, or the low auditory alarm may replace the alarms that were previously activated. However, if the distance measured most recently is less than the comfort distance, then the parent device may deactivate the alarms that were already activated, at step 572 and step 564. For example, the visual and sensory alarm is deactivated.

After step 570, a distance between the parent device and the child device is measured again. Optionally, when the distance is measured, the child device and the parent device exchange passwords or unique ID's at step 574. Another distance and password determination is made at step 576.

If the distance measured most recently is greater than or equal to the comfort distance, then a fourth alarm is triggered at step 578. For example, a high auditory alarm may be triggered. The high auditory alarm may be combined with the visual alarm and sensory alarm that was already activated, or the high auditory alarm may replace the alarms that were previously activated. However, if the distance measured most recently is less than the comfort distance, then the parent device may deactivate the alarms that were already activated at steps 580,572, and 564. For example, the low auditory alarm is deactivated.

After step 578, a distance between the parent device and the child device is measured again. Optionally, when the distance is measured, the child device and the parent device exchange passwords or unique ID's at step 582. Another distance and password determination is made at step 584.

If the distance measured most recently is greater than or equal to the comfort distance, then the previous alarm is maintained by reverting back to step 578. For example, the execution of the high auditory alarm may be maintained. However, if the distance measured most recently is less than the comfort distance, then the parent device may deactivate the alarms that were already activated at steps 586, 580, 572, and 564. For example, the high auditory alarm is deactivated.

It should be understood that the steps shown in FIGS. 5A and 5B are illustrative and that additional steps may be added and that some steps may be omitted.

Figure 7:
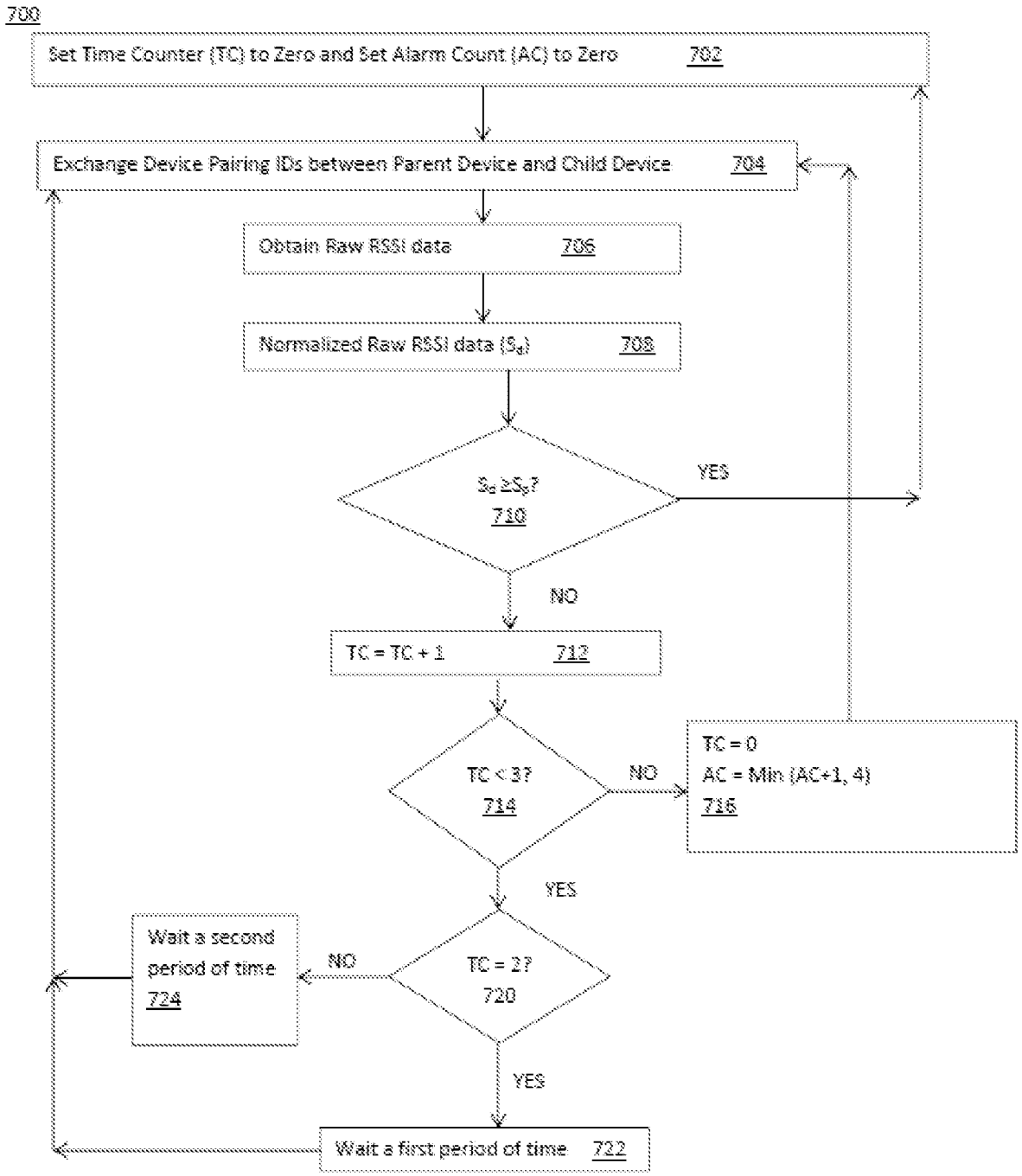
FIGS. 7-9 show different illustrative processes according to various embodiments.

FIG. 7 shows an illustrative process 700 according to an embodiment. Process 700 actives alarms based on an amount of time the child device is located outside of the comfort distance range. Process 700 can begin at step 702 by setting a time counter (TC) to zero and by setting an alarm counter (AC) to zero. The time counter is incremented after different time intervals have elapsed while the child device is located outside of the comfort distance range. The time counter can count up to a certain number (e.g., three in this example), and that number is reached, the alarm counter can be incremented. The alarm counter can keep track of which alarm group is active. At step 704, a child device and a parent device exchange IDs to confirm whether both devices are permitted to communicate with each other. When the devices are paired, after exchanging IDs, raw RSSI data is obtained (at step 706), with raw RSSI data representing signal strength between the two devices. The raw RSSI data can be normalized using a statistical technique at step 708 to produce a normalized signal strength between the two devices. Normalization can serve as a filter for smoothing out noise in the data and for eliminating false positives.

At step 710, a determination is made whether the normalized signal strength ($S_d$) is greater than or equal to a safety perimeter signal strength ($S_p$). The safety perimeter signal strength can be a default value or can be variable based on user input or a device's ability to discern, for example, whether it is located in an in indoor environment of or an outdoor environment. If the normalized signal strength is greater than or equal to the safety perimeter signal strength—indicating that the child device is within the comfort distance range of the parent device—process 700 may revert back to step 702. If the normalized signal strength is less than the safety perimeter signal strength—indicating that the child device is outside of the comfort distance range of the parent device—process 700 can proceed to step 712, which increments the time counter by one (1).

At step 714, a determination is made whether the time counter is less than a first predetermined number (e.g., three (3)). If the determination at step 714 is YES, process 700 determines whether the time counter is equal to a second predetermined number (e.g., two (2)) at step 720. If the determination at step 720 is YES process 700 can proceed to step 722 where process 700 wait for a first period of time before reverting back to step 704. The first period of time can be on the order of milliseconds, for example. If the determination at step 720 is NO, process 700 can proceed to step 724, wherein process 700 waits for a second period of time before reverting back to step 704. The second period of time can be on the order of seconds, for example, and is greater in duration than the first period of time. The time delays in steps 722 and 724 are designed to ensure that the child device is located outside of the comfort distance range for at least a fixed period of time defined by first period of time in addition to the second period of time. The first period of time has a shorter duration than the second period of time because it is now known at this point that the child device continues to be located outside of the comfort distance range and it is desirable to ensure that the child is outside the comfort distance range and then activate the appropriate alarm group.

If the determination at step 714 is NO—indicating that the child device has been located outside of the comfort distance range for at least fixed period time including the first and second time periods—process 700 can proceed to step 716, which can reset the time counter to zero and can set the alarm counter to a minimum of 1) current alarm counter value plus one or 2) a maximum alarm counter value (e.g., 4). Step 716 either increments the alarm counter or sets the alarm counter to the maximum value, which corresponds to the highest alarm group number. The alarm grouping is activated corresponding to the alarm counter.

It should be understood that the steps shown in FIG. 7 are illustrative and that additional steps may be added and that some steps may be omitted.

Figure 8:
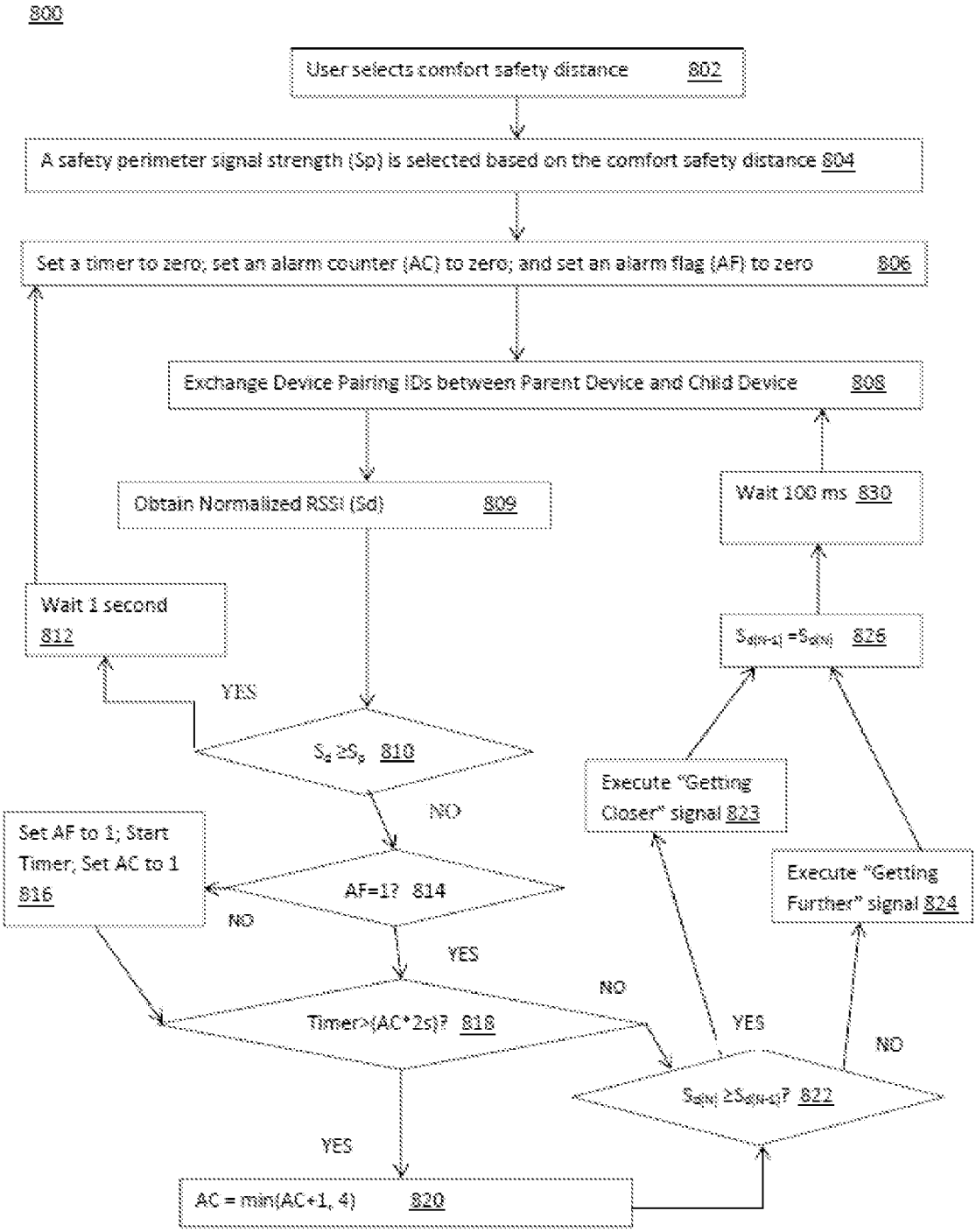

FIG. 8 shows an illustrative process 800 according to an embodiment. Process 800 actives alarms based on an amount of time the child device is located outside of the comfort distance range. Process 800 can begin at step 802 by receiving a user selected comfort distance. At step 804, a safety perimeter signal strength is selected based on the user selected comfort distance. At step 806, a timer is set to zero, an alarm counter is set to zero, and an alarm flag is set to zero. At step 808, device IDs are exchanged between a parent device and a child device.

At step 809, a normalized RSSI signal is obtained, wherein the normalized RSSI signal is indicative of a distance between the child device and the parent device. At step 810 a determination is made whether the normalized RSSI signal is greater than or equal to the safety perimeter signal strength. If the determination at step 810 is YES, process 800 times out for a fixed period of time (e.g. one second) at step 812 before reverting to step 806. If the determination at step 810 is NO, a determination is made whether the alarm flag is set to 1 or TRUE at step 814. If the determination at step 814 is NO, process 800 sets the alarm flag to 1 or TRUE, starts the time counter, and sets the alarm counter to one (e.g. 1) at step 816 before proceeding to step 818. If the determination at step 814 is YES, process 800 proceeds to step 818. At step 818, a determination is made whether the timer is greater than a product of the alarm counter and a second fixed time period (e.g., 2 seconds). Using the alarm counter and the second fixed period of time as criteria for determining whether to increase the alarm count can result in a linear progression that defines the cadence in which alarm group is activated. For example, according to this example, alarm group 1 is activated after two seconds elapse, alarm group 2 is activated after four seconds elapse, alarm group 3 is activated after six seconds elapse, and so on. If desired, the cadence can be non-linear or exponential, and this can be achieved by comparing the timer to different thresholds. For example, a lookup table can be used to determine which criteria should be used based on the current alarm count.

If the determination at step 818 is NO, process 800 can proceed to step 822. At step 822, a determination is made whether a current normalized RSSI signal is greater than or equal to a prior normalized RSSI signal. If the determination at step 822 is YES, the child device and/or parent device may indicate that the child device is getting closer to the parent device at step 823. If the determination at step 822 is NO, the child device and/or parent device may indicate that the child device is getting further away from the parent device at step 824. After step 823 or step 824 is executed, the prior normalized RSSI signal ($S_{d(N-1)}$) is set to the current normalized RSSI signal ($S_{d(N)}$) at step 826. Process 800 can operate a delay timer for a third period of time (e.g., 100 ms) at step 830 before reverting to step 808.

If the determination at step 818 is YES, process 800 can set the alarm counter to a minimum of 1) current alarm counter value plus one or 2) a maximum alarm counter value (e.g., 4) at step 820. After step 820, process 800 proceeds to step 822, as described above.

It should be understood that the steps shown in FIG. 8 are illustrative and that additional steps may be added and that some steps may be omitted.

Figure 9:
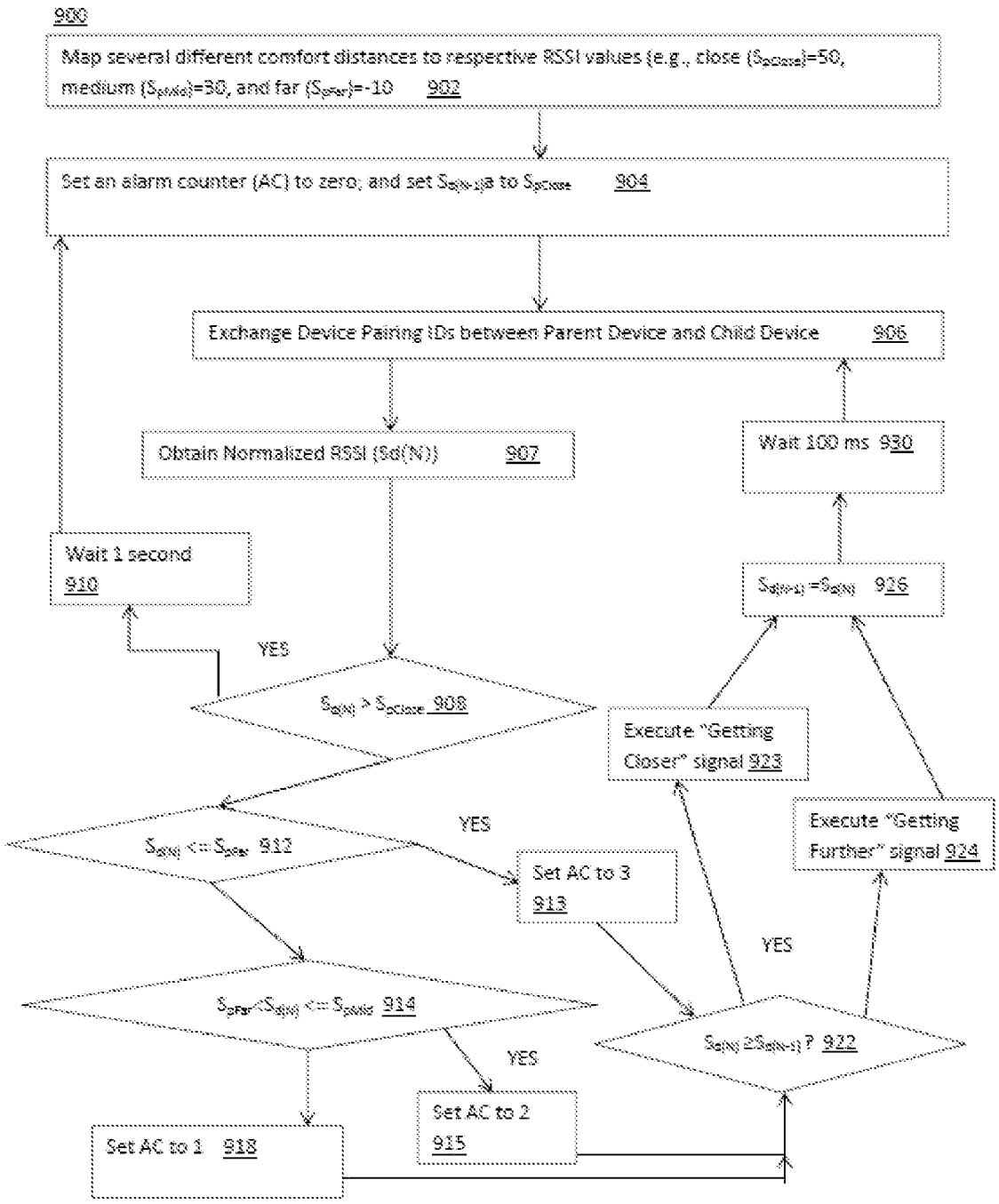

FIG. 9 shows illustrative process 900 according to an embodiment. Process 900 may be operative to activate alarms based on distance between the parent device and the child device. Process 900 may start at step 902 by mapping several different comfort distances to respective RSSI values. For example, three different comfort distances of close ($S_{pClose}$), medium ($S_{pMid}$), and far ($S_{pFar}$) may be assigned to respective RSSI values of 50, 30, and −10. At step 904, an alarm counter is set to zero and a previous normalized RSSI value ($S_{d(N-1)}$) is set to the close comfort distance RSSI value ($S_{pClose}$). At step 906, device IDs are exchanged between a parent device and a child device.

At step 907, a normalized RSSI signal ($S_{d(N)}$) is obtained, wherein the normalized RSSI signal is indicative of a distance between the child device and the parent device. At step 908 a determination is made whether the normalized RSSI signal ($S_{d(N)}$) is greater than ($S_{pClose}$). If the determination at step 908 is YES, process 900 operates a delay timer or times out for a fixed period of time (e.g. one second) at step 910 before reverting to step 904. If the determination at step 908 is NO, a determination is made whether the normalized RSSI signal ($S_{d(N)}$) is less than or equal to ($S_{pFar}$) at step 912. If the determination at step 912 is YES, the alarm count is set to 3 at step 913 (thereby causing alarms corresponding to alarm count 3 to activate).

After the alarms are active at step 913, process 900 proceeds to step 922, where a determination is made whether a current normalized RSSI signal ($S_{d(N)}$) is greater than or equal to a prior normalized RSSI signal ($S_{d(N-1)}$). If the determination at step 922 is YES, the child device and/or parent device may indicate that the child device is getting closer to the parent device at step 923. If the determination at step 922 is NO, the child device and/or parent device may indicate that the child device is getting further away from the parent device at step 924. After step 923 or step 924 is executed, the prior normalized RSSI signal is set to the current normalized RSSI signal at step 926. Process 900 can time out for a second period of time (e.g., 100 ms) at step 930 before reverting to step 906.

If the determination at step 912 is NO, process 900 can determine whether the current normalized RSSI signal ($S_{d(N)}$) is less than or equal to ($S_{pMid}$) and greater than ($S_{pFar}$) at step 914. If the determination at step 914 is YES, process 900 can set the alarm count to 2 and activate the corresponding the alarms at step 915. After the alarms are activated, process 900 can proceed to step 922. If the determination at step 914 is NO, process 900 can set the alarm count to 1 and activate the corresponding alarm(s) at step 918. After the alarms are activated at step 918, process 900 can proceed to step 922.

It should be understood that the steps shown in FIG. 9 are illustrative and that additional steps may be added and that some steps may be omitted.

Figure 6:
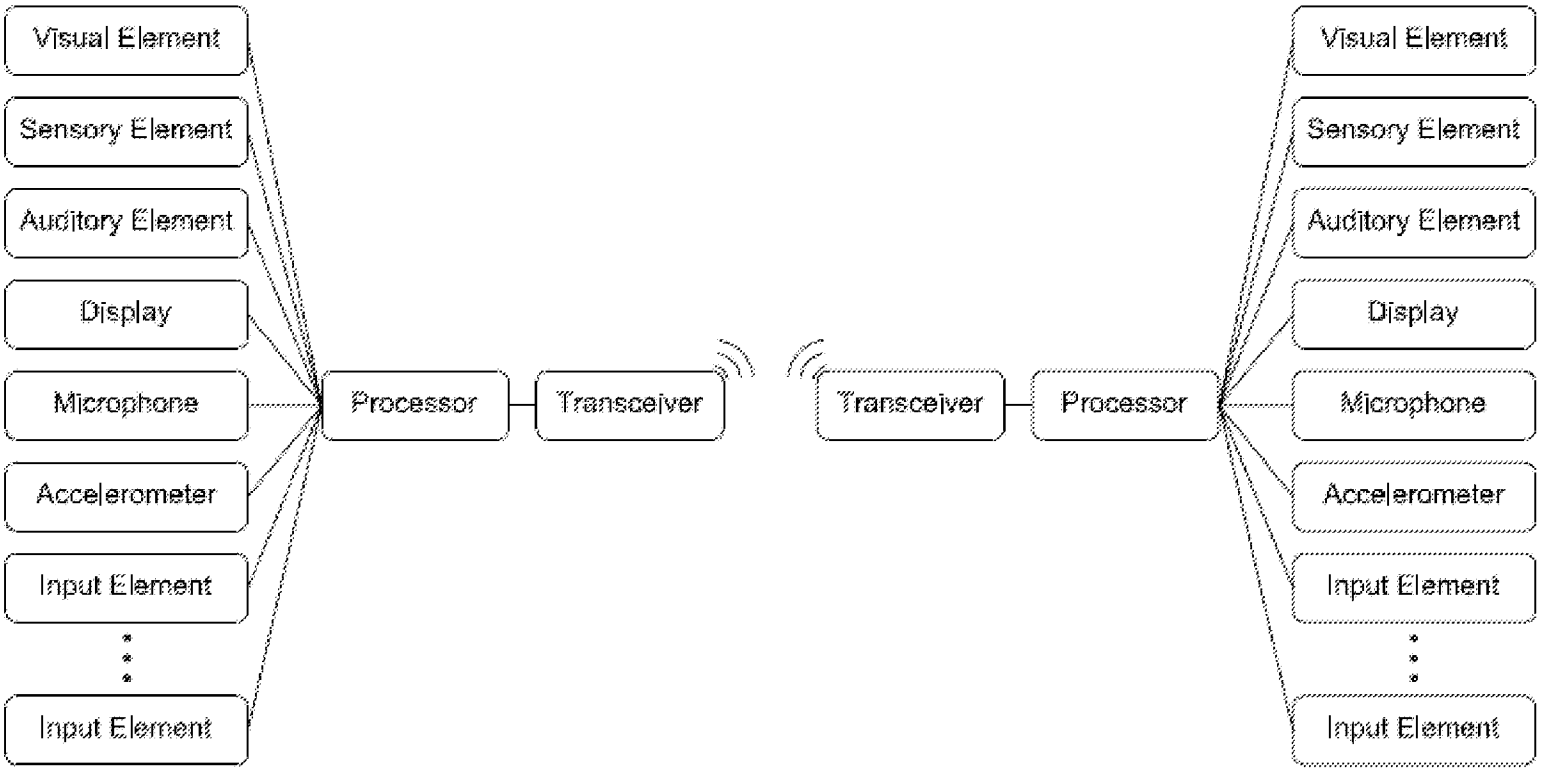
FIG. 6 illustrates a block diagram of components of parent and child devices according to an embodiment.

FIG. 6 illustrates a block diagram of components of the devices used in the safety system and network in which an implementation according to an embodiment. Each of the parent device and child device is a computing device. The computing device includes at least a processor and a transceiver. The transceiver is used to transmit and receive communications from other transmitters or receivers of other devices. The computing device may also include: a visual element, such as a display screen, a lighting element (e.g., an LED) or the like; a sensory element, such as a vibration mechanism, a force mechanism, movement mechanism, and the like; a auditory element, such as speakers and the like; a display element, such as a display screen; a microphone; an accelerometer; and an input element.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the embodiments as claimed.

Preferred embodiments are described herein, including the best mode known to the inventor for carrying out the claimed subject matter. Of course, variations of those preferred embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

The invention claimed is:

1. A system for generating alerts, comprising:

a parent device comprising a first processor and a first transceiver;

a child device comprising a second processor and a second transceiver operative to wirelessly communicate with the first transceiver;

wherein the first processor is operative to:

repeatedly determine a distance between the parent device and the child device;

when the distance is equal to or exceeds a comfort distance range:

initiate a timer;

initially set an alarm count to one;

continue to run the timer while the distance exceeds the comfort distance range;

if the timer exceeds a product of the alarm count and a predetermined period of time, set the alarm count to a minimum of 1) the alarm count plus one and 2) a maximum alarm count;

select an alarm group from a plurality of alarm groups to trigger based on the alarm count, wherein each of the plurality of alarm groups corresponds to a respective elapsed time range, and wherein the plurality of alarm groups are characterized as exhibiting progressively increased alert levels commensurate with an increase in elapsed time; and instruct the child device to the trigger the selected alarm group by sending an alarm instruction to the child device via the first transceiver, the alarm instruction including the selected alarm group;

when the distance is less than the comfort distance range:

reset the timer; and reset the alarm count to zero; and wherein the second processor is operative to:

receive the alarm instruction, via the second transceiver, from the parent device; and activate the selected alarm group.

2. The system of claim 1, wherein the first processor is operative to send a cease alarm instruction to the child device via the first transceiver when the alarm count is reset to zero; and wherein the second processor is operative to cease activating the selected alarm group in response to receiving, via the second transceiver, the cease alarm instruction.

3. The system of claim 1, wherein the first processor is operative to analyze at least one characteristic of a wireless signal being transmitted between the parent device and the child device to determine the distance.

4. The system of claim 1, wherein the plurality of alarm groups comprises first, second, third, and fourth alarm groups, wherein the first alarm group comprises a visual alarm, wherein a second alarm group comprises a sensory alarm and the visual alarm, wherein the third alarm group comprises a first auditory alarm, the sensory alarm, and the visual alarm, and wherein the fourth alarm group comprises a second auditory alarm, the sensory alarm, and the visual alarm.

5. The system of claim 4, wherein the first auditory alarm is emitted at a first signal level and the second auditory alarm is emitted at a second signal level, wherein the second signal level is greater than the first signal level.

6. The system of claim 4, wherein the first auditory alarm and second auditory alarm each include an auditory sound, a voice recording, or a combination thereof.

7. The system of claim 4, wherein the first, second, third, and fourth alarm groups correspond to respective first, second, third, and fourth elapsed time ranges, wherein the first elapsed time range includes a timer start time to a first elapsed time, wherein the second elapsed time range includes elapsed time after the first elapsed time to a second elapsed time, wherein the third elapsed time range includes elapsed time after the second elapsed time to a third elapsed time, and wherein the fourth time range includes elapsed time after the third elapsed time.

8. The system of claim 1, wherein the child device is turned ON and OFF solely at the control of the parent device.

9. The system of claim 1, wherein the first processor is operative to receive via a user input the comfort distance range or on an artificial intelligence defined comfort distance range.

10. A method for monitoring spatial distances between a first device and a second device, the method comprising:

determining a normalized signal strength value between the first device and the second device;

when the normalized signal strength value is greater than or equal to a safety perimeter signal strength value: resetting a time counter to zero and resetting an alarm count to zero;

when the normalized signal strength value is less than safety perimeter signal strength value:

incrementing the time counter;

if the time counter is greater than or equal to a first number: resetting the time counter to zero, setting the alarm count to a minimum of 1) the alarm count plus one and 2) a maximum alarm count, and reverting to the determining;

if the time counter is equal to a second number, delaying for a first period of time before reverting to the determining, wherein the second number is less than the first number; and if the time counter is not equal to the second number, delaying for a second period of time before reverting to the determining, wherein the second period of time is greater than the first period of time;

selecting an alarm group from a plurality of alarm groups based on the alarm count, wherein each of the plurality of alarm groups corresponds to a respective elapsed time range, and wherein the plurality of alarm groups are characterized as exhibiting progressively increased alert levels commensurate with an increase in elapsed time; and activating the selected alarm group in at least one of the first and second devices.

11. The method of claim 10, further comprising:

while the normalized signal strength value is less than safety perimeter signal strength value:

indicating via a user interface in at least one of the first and second devices that the child device is getting closer when a current normalized signal strength value is greater than or equal to a preceding normalized signal strength value; and indicating via the user interface in at least one of the first and second devices that the child device is not getting closer when a current normalized signal strength value is less than the preceding normalized signal strength value.

12. The method of claim 10, wherein each of the plurality of alarm groups comprises at least one type of alarm selected from a visual alarm type, a sensory alarm type, and an auditory alarm type.

13. The method of claim 10, wherein a first subset of the plurality of alarm groups comprises only one type of alarm selected from a visual alarm type, a sensory alarm type, and an auditory alarm type, and wherein a second subset of the plurality of alarm groups comprises multiple alarm types selected from the visual alarm type, the sensory alarm type, and the auditory alarm type.

14. The method of claim 10, wherein the normalized signal strength value is a normalized received signal strength indicator value.

15. The method of claim 10, further comprising:

selecting the safety perimeter signal strength value from a plurality of different safety perimeter signal strength values, wherein the selecting is performed in response to a user input or in response to a determination of a location of the parent device.

16. A method for monitoring spatial distances between a first device and a second device, the method comprising:

determining a distance between the first device and the second device;

initiating a timer when the distance exceeds a comfort distance range;

identifying an alarm zone of a plurality of alarm zones located outside of the comfort distance range that the distance is associated with, wherein each of the plurality of alarm zones has an upper distance limit and a lower distance limit;

selecting an alarm group from of a plurality of alarm groups based on one of (1) an elapsed time derived from the timer and (2) the identified alarm zone enables an appropriate one of the plurality of alarm groups to be activated when conditions associated with the elapsed time are met but conditions associated with the plurality of alarm zones are not met, or when conditions associated with the plurality of alarm zones are met but conditions associated with the elapsed time are not met, wherein each of the plurality of alarm groups corresponds to a respective elapsed time range and to one of the plurality of alarm zones, and wherein the plurality of alarm groups are characterized as exhibiting progressively increased alert levels commensurate with an increase in the elapsed time or an increase in the distance between the first device and the second device; and activating the selected alarm group in at least one of the first and second devices.

17. The method of claim 16, further comprising:

resetting the timer when the distance is less than or equal to the comfort distance range; and deactivating the selected alarm group when the distance is less than or equal to the comfort distance range.

18. The method of claim 16, further comprising:

determining that the distance between the first device and the second device is decreasing and that the distance still exceeds the comfort distance range;

instructing, in response to said determining that the distance between the first device and the second device is decreasing and that the distance still exceeds the comfort distance range, at least one of the first device and the second device to issue a positive alert indicating that a user of the at least one of the first device and the second device is moving closer to within the comfort distance range;

determining that the distance between the first device and the second device is increasing and that the distance still exceeds the comfort distance range; and instructing, in response to said determining that the distance between the first device and the second device is increasing and that the distance still exceeds the comfort distance range, at least one of the first device and the second device to issue a negative alert indicating that a user of the at least one of the first device and the second device is moving further from the comfort distance range.

19. The method of claim 16, further comprising:

initiating a search feature, via the first device or the second device, independent of whether the distance between the first device and the second device exceeds the comfort distance range.

20. The method of claim 10, wherein the time counter is used to execute as a data smoothing function to prevent false positives.

* * * * *